US007841697B2

(12) United States Patent
McAvoy et al.

(10) Patent No.: US 7,841,697 B2
(45) Date of Patent: Nov. 30, 2010

(54) PRINTHEAD WITH REDUNDANT NOZZLE CHAMBER INLETS FOR MINIMIZING EFFECTS OF BLOCKAGES

(75) Inventors: Gregory John McAvoy, Balmain (AU); Matthew Taylor Worsman, Balmain (AU); Kia Silverbrook, Balmain (AU)

(73) Assignee: Silverbrook Research Pty Ltd, Balmain, New South Wales (AU)

( * ) Notice: Subject to any disclaimer, the term of this patent is extended or adjusted under 35 U.S.C. 154(b) by 497 days.

(21) Appl. No.: 11/946,839

(22) Filed: Nov. 29, 2007

(65) Prior Publication Data

US 2009/0141082 A1 Jun. 4, 2009

(51) Int. Cl.
*B41J 2/14* (2006.01)
*B41J 2/16* (2006.01)

(52) U.S. Cl. ..... 347/47; 347/54; 347/65

(58) Field of Classification Search ..... 347/44, 347/47, 56, 61–65, 67, 40, 42, 43
See application file for complete search history.

(56) References Cited

U.S. PATENT DOCUMENTS

| | | | | |
|---|---|---|---|---|
| 5,519,423 | A * | 5/1996 | Moritz et al. | 347/65 |
| 6,543,879 | B1 * | 4/2003 | Feinn et al. | 347/40 |
| 2007/0081032 | A1 | 4/2007 | Silverbrook | |
| 2007/0081044 | A1 | 4/2007 | Silverbrook | |

FOREIGN PATENT DOCUMENTS

| | | | |
|---|---|---|---|
| EP | 1336486 | B | 8/2003 |
| EP | 1491340 | A | 12/2004 |

* cited by examiner

*Primary Examiner*—Juanita D Stephens

(57) ABSTRACT

A printhead comprising a plurality of inkjet nozzle assemblies is provided. Each nozzle assembly comprises a nozzle chamber formed on a substrate. The nozzle chamber comprises a roof spaced apart from the substrate and sidewalls extending between the roof and the substrate. The nozzle chamber has an ink ejection opening defined in the roof, a first ink inlet defined in one of the sidewalls, and a second ink inlet defined in a floor of the nozzle chamber. Each ink inlet is in fluid communication with a common ink reservoir. The nozzle assembly further comprises an actuator for ejection of ink through the ink ejection opening.

15 Claims, 8 Drawing Sheets

PRINTHEAD WITH REDUNDANT NOZZLE CHAMBER INLETS FOR MINIMIZING EFFECTS OF BLOCKAGES

FIELD OF THE INVENTION

The present invention relates to the field of printers and particularly inkjet printheads. It has been developed primarily to improve print quality and reliability in high resolution printheads.

CROSS REFERENCE TO OTHER RELATED APPLICATIONS

The following applications have been filed by the Applicant simultaneously with this application:

| | | |
|---|---|---|
| 11/946,838 | 11/946,837 | 11/946,840 |

The disclosures of these co-pending applications are incorporated herein by reference.

The following patents or patent applications filed by the applicant or assignee of the present invention are hereby incorporated by cross-reference.

| | | | | |
|---|---|---|---|---|
| 6,276,850 | 6,520,631 | 6,158,907 | 6,539,180 | 6,270,177 |
| 6,405,055 | 6,628,430 | 6,835,135 | 6,626,529 | 6,981,769 |
| 7,125,338 | 7,125,337 | 7,136,186 | 7,286,260 | 7,145,689 |
| 7,130,075 | 7,081,974 | 7,177,055 | 7,209,257 | 6,443,555 |
| 7,161,715 | 7,154,632 | 7,158,258 | 7,148,993 | 7,075,684 |
| 7,400,346 | 7,385,630 | 7,385,629 | 7,385,628 | 7,460,153 |
| 6,966,659 | 6,988,841 | 7,077,748 | 7,255,646 | 7,070,270 |
| 7,014,307 | 7,158,809 | 7,217,048 | 7,430,067 | 7,341,341 |
| 7,567,221 | 7,548,220 | 7,271,829 | 7,465,109 | 7,431,519 |
| 11/483,061 | 7,469,982 | 11/520,735 | 11/505,858 | 7,556,564 |
| 7,556,371 | 7,506,943 | 7,695,082 | 7,460,882 | 7,564,580 |
| 7,215,441 | 11/650,545 | 7,056,040 | 6,942,334 | 7,556,325 |
| 11/740,265 | 7,461,985 | 7,470,021 | 7,572,003 | 7,458,678 |
| 7,688,351 | 11/750,285 | 7,654,905 | 7,461,934 | 7,726,805 |
| 11/845,669 | 6,799,853 | 7,237,896 | 6,749,301 | 7,740,579 |
| 7,137,678 | 7,252,379 | 7,144,107 | 7,426,050 | 7,690,785 |
| 7,573,501 | 7,220,068 | 7,270,410 | 7,241,005 | 7,108,437 |
| 7,140,792 | 7,224,274 | 7,463,283 | 10/503,927 | 7,590,545 |
| 7,349,777 | 7,354,121 | 7,195,325 | 7,229,164 | 7,150,523 |
| 10/503,889 | 7,154,580 | 6,906,778 | 7,167,158 | 7,128,269 |
| 6,688,528 | 6,986,613 | 6,641,315 | 7,278,702 | 7,625,054 |
| 7,150,524 | 7,155,395 | 6,915,140 | 6,999,206 | 6,795,651 |
| 6,883,910 | 7,118,481 | 7,136,198 | 7,092,130 | 6,786,661 |
| 6,808,325 | 7,448,747 | 7,448,746 | 7,219,990 | 7,591,553 |
| 6,750,901 | 6,476,863 | 6,788,336 | 6,322,181 | 6,597,817 |
| 6,227,648 | 6,727,948 | 6,690,419 | 7,431,281 | 6,619,654 |
| 6,969,145 | 6,679,582 | 7,328,896 | 6,568,670 | 6,866,373 |
| 7,280,247 | 7,008,044 | 6,742,871 | 6,966,628 | 6,644,781 |
| 6,969,143 | 6,767,076 | 6,834,933 | 6,692,113 | 6,913,344 |
| 6,727,951 | 7,128,395 | 7,036,911 | 7,032,995 | 6,969,151 |
| 6,955,424 | 6,969,162 | 7,456,861 | 6,942,315 | 7,354,122 |
| 7,234,797 | 6,986,563 | 7,295,211 | 7,701,506 | 7,286,162 |
| 7,283,159 | 7,077,330 | 6,196,541 | 7,303,257 | 7,465,012 |
| 7,226,144 | 7,461,918 | 7,267,428 | 7,401,891 | 7,380,924 |
| 7,093,929 | 7,690,764 | 7,441,870 | 7,629,999 | 7,290,862 |
| 7,646,403 | 7,591,528 | 6,195,150 | 7,581,814 | 11/782,588 |
| 11/854,435 | 11/853,817 | 7,413,285 | 7,712,867 | 6,362,868 |
| 6,831,681 | 6,431,669 | 6,362,869 | 6,472,052 | 6,356,715 |
| 6,894,694 | 6,636,216 | 6,366,693 | 6,329,990 | 6,459,495 |
| 6,137,500 | 6,690,416 | 7,050,143 | 6,398,328 | 7,110,024 |
| 6,431,704 | 6,879,341 | 6,415,054 | 6,665,454 | 6,542,645 |
| 6,486,886 | 6,381,361 | 6,317,192 | 6,850,274 | 6,646,757 |
| 6,624,848 | 6,357,135 | 6,271,931 | 6,353,772 | 6,106,147 |
| 6,665,008 | 6,304,291 | 6,305,770 | 6,289,262 | 6,315,200 |
| 6,217,165 | 6,496,654 | 6,859,225 | 6,924,835 | 6,647,369 |
| 6,943,830 | 7,535,582 | 7,021,745 | 6,712,453 | 6,460,971 |

-continued

| | | | | |
|---|---|---|---|---|
| 6,428,147 | 6,416,170 | 6,402,300 | 6,464,340 | 6,612,687 |
| 6,412,912 | 6,447,099 | 6,837,567 | 6,505,913 | 7,128,845 |
| 6,733,684 | 7,249,108 | 6,566,858 | 6,331,946 | 6,246,970 |
| 6,442,525 | 7,346,586 | 7,685,423 | 6,374,354 | 7,246,098 |
| 6,816,968 | 6,757,832 | 6,334,190 | 6,745,331 | 7,249,109 |
| 7,197,642 | 7,093,139 | 7,509,292 | 7,685,424 | 7,743,262 |
| 7,210,038 | 7,401,223 | 7,702,926 | 7,716,098 | 7,757,084 |
| 7,747,541 | 7,657,488 | 7,119,836 | 7,283,162 | 7,286,169 |
| 7,724,282 | 7,170,652 | 6,967,750 | 6,995,876 | 7,099,051 |
| 7,172,191 | 7,243,916 | 7,222,845 | 7,559,472 | 7,285,227 |
| 7,063,940 | 7,453,586 | 7,193,734 | 7,086,724 | 7,090,337 |
| 7,278,723 | 7,140,717 | 7,558,476 | 11/209,711 | 7,256,824 |
| 7,140,726 | 7,156,512 | 7,186,499 | 7,461,924 | 7,525,687 |
| 7,357,497 | 7,530,665 | 7,404,633 | 6,750,944 | 7,468,810 |
| 7,291,447 | 7,556,257 | 7,533,877 | 11/778,561 | 11/839,532 |
| 7,665,834 | 11/869,710 | 7,468,140 | 11/927,403 | 7,633,535 |
| 6,985,207 | 6,773,874 | 6,650,836 | 7,324,142 | 7,705,891 |
| 7,250,975 | 7,295,343 | 6,880,929 | 7,236,188 | 7,236,187 |
| 7,155,394 | 7,557,829 | 7,609,411 | 7,055,927 | 6,986,562 |
| 7,052,103 | 7,312,845 | 7,492,490 | 10/656,791 | 7,375,746 |
| 7,602,423 | 7,289,142 | 7,095,533 | 6,914,686 | 6,896,252 |
| 6,820,871 | 6,834,851 | 6,848,686 | 6,830,246 | 6,851,671 |
| 7,460,152 | 7,092,011 | 7,187,404 | 7,483,050 | 10/753,458 |
| 6,878,299 | 6,929,348 | 6,921,154 | 7,453,492 | 6,913,346 |
| 7,576,795 | 7,576,794 | 7,385,639 | 7,557,853 | 7,714,889 |
| 7,593,058 | 7,246,897 | 7,077,515 | 7,551,202 | 7,505,068 |
| 10/853,659 | 7,747,154 | 6,913,875 | 7,021,758 | 7,033,017 |
| 7,161,709 | 7,099,033 | 7,147,294 | 7,156,494 | 7,360,872 |
| 7,434,915 | 7,032,998 | 7,044,585 | 7,296,867 | 6,994,424 |
| 7,384,134 | 7,258,435 | 7,097,263 | 7,001,012 | 7,004,568 |
| 7,040,738 | 7,188,933 | 7,027,080 | 7,025,446 | 6,991,321 |
| 7,131,715 | 7,261,392 | 7,207,647 | 7,182,435 | 7,097,285 |
| 7,331,646 | 7,097,284 | 7,083,264 | 7,147,304 | 7,232,203 |
| 7,156,498 | 7,201,471 | 7,465,023 | 7,549,728 | 7,517,057 |
| 7,210,764 | 7,381,342 | 7,520,593 | 7,465,026 | 7,524,029 |
| 7,407,265 | 7,581,816 | 7,618,110 | 6,710,457 | 6,775,906 |
| 6,507,099 | 7,221,043 | 7,107,674 | 7,154,172 | 7,402,894 |
| 7,247,941 | 7,402,896 | 7,307,354 | 7,479,697 | 6,530,339 |
| 6,631,897 | 6,851,667 | 6,830,243 | 6,860,479 | 6,997,452 |
| 7,000,913 | 7,204,482 | 7,398,967 | 11/281,679 | 7,401,989 |
| 6,238,044 | 6,425,661 | 7,364,256 | 7,258,417 | 7,293,853 |
| 7,328,968 | 7,270,395 | 7,461,916 | 7,510,264 | 7,334,864 |
| 7,255,419 | 7,284,819 | 7,229,148 | 7,258,416 | 7,273,263 |
| 7,270,393 | 6,984,017 | 7,347,526 | 7,357,477 | 7,156,497 |
| 7,726,778 | 11/748,482 | 7,562,960 | 11/779,851 | 7,524,017 |
| 11/853,816 | 11/853,814 | 11/853,786 | 11/872,037 | 11/856,694 |
| 7,465,015 | 7,364,255 | 7,357,476 | 7,758,148 | 7,284,820 |
| 7,341,328 | 7,246,875 | 7,322,669 | 11/764,760 | 11/853,777 |
| 7,445,311 | 7,452,052 | 7,455,383 | 7,448,724 | 7,441,864 |
| 7,637,588 | 7,648,222 | 7,669,958 | 7,607,755 | 7,699,433 |
| 7,658,463 | 6,431,777 | 6,334,664 | 6,447,113 | 7,239,407 |
| 6,398,359 | 6,652,089 | 6,652,090 | 7,057,759 | 6,631,986 |
| 7,187,470 | 7,280,235 | 7,414,749 | 11/744,210 | 7,744,208 |
| 6,471,331 | 6,676,250 | 6,347,864 | 6,439,704 | 6,425,700 |
| 6,588,952 | 6,626,515 | 6,722,758 | 6,871,937 | 11/060,803 |
| 7,344,226 | 7,328,976 | 11/685,084 | 7,669,967 | 11/685,090 |
| 11/740,925 | 7,605,009 | 7,568,787 | 7,249,942 | 7,206,654 |
| 7,162,324 | 7,162,325 | 7,231,275 | 7,146,236 | 7,278,847 |
| 10/753,499 | 6,997,698 | 7,220,112 | 7,231,276 | 7,373,214 |
| 7,220,115 | 7,195,475 | 7,144,242 | 7,306,323 | 7,306,319 |
| 7,467,837 | 7,322,674 | 7,513,596 | 7,416,276 | 11/736,545 |
| 7,467,025 | 7,556,329 | 11/749,159 | 7,706,909 | 11/775,160 |
| 11/853,755 | 7,591,536 | 7,597,420 | 6,786,420 | 6,827,282 |
| 6,948,661 | 7,073,713 | 7,475,825 | 7,093,762 | 7,083,108 |
| 7,222,799 | 7,201,319 | 7,524,045 | 7,703,910 | 11/518,238 |
| 11/518,280 | 7,663,784 | 11/518,243 | 11/518,242 | 7,032,899 |
| 6,854,724 | 7,331,651 | 7,334,870 | 7,334,875 | 7,416,283 |
| 7,438,386 | 7,461,921 | 6,350,023 | 6,318,849 | 6,592,207 |
| 6,439,699 | 6,312,114 | 7,506,958 | 7,472,981 | 7,448,722 |
| 7,575,297 | 7,438,381 | 7,441,863 | 7,438,382 | 7,425,051 |
| 7,399,057 | 7,695,097 | 7,686,419 | 7,753,472 | 7,448,720 |
| 7,448,723 | 7,445,310 | 7,399,054 | 7,425,049 | 7,367,648 |
| 7,370,936 | 7,401,886 | 7,506,952 | 7,401,887 | 7,384,119 |
| 7,401,888 | 7,387,358 | 7,413,281 | 7,530,663 | 7,467,846 |
| 7,669,957 | 11/482,963 | 7,758,174 | 7,695,123 | 11/482,974 |
| 7,604,334 | 11/482,987 | 7,708,375 | 7,695,093 | 7,695,098 |
| 7,722,156 | 7,703,882 | 7,510,261 | 7,722,153 | 7,581,812 |
| 7,641,304 | 7,753,470 | 10/803,074 | 7,570,389 | 7,040,823 |
| 7,535,599 | 7,528,987 | 7,661,779 | 10/803,079 | 10/922,971 |

-continued

| | | | | |
|---|---|---|---|---|
| 7,672,012 | 10/922,842 | 7,692,815 | 7,419,259 | 7,125,185 |
| 7,229,226 | 7,364,378 | 7,465,019 | 7,243,835 | 10/815,630 |
| 7,703,693 | 10/815,638 | 7,251,050 | 10/815,642 | 7,097,094 |
| 7,137,549 | 10/815,618 | 7,156,292 | 7,427,015 | 10/815,635 |
| 7,357,323 | 7,654,454 | 7,137,566 | 7,131,596 | 7,128,265 |
| 7,207,485 | 7,197,374 | 7,175,089 | 10/815,617 | 7,537,160 |
| 7,178,719 | 7,506,808 | 7,207,483 | 7,296,737 | 7,270,266 |
| 7,314,181 | 11/488,162 | 11/488,163 | 11/488,167 | 11/488,168 |
| 11/488,165 | 11/488,166 | 7,267,273 | 7,383,991 | 7,383,984 |
| 7,605,940 | 7,128,270 | 11/041,650 | 7,677,445 | 7,506,168 |
| 7,441,712 | 7,663,789 | 7,681,800 | 7,461,778 | 11/863,257 |
| 11/863,258 | 11/041,609 | 11/041,626 | 7,537,157 | 11/041,624 |
| 7,395,963 | 11/863,268 | 11/863,269 | 7,637,419 | 7,676,382 |
| 7,464,879 | 7,457,961 | 7,739,509 | 7,467,300 | 7,467,299 |
| 7,565,542 | 11/863,263 | 7,469,819 | 7,484,101 | 7,472,278 |
| 7,467,301 | 7,457,007 | 7,150,398 | 7,159,777 | 7,450,273 |
| 7,188,769 | 7,097,106 | 7,070,110 | 7,243,849 | 7,314,177 |
| 7,469,836 | 7,568,629 | 6,227,652 | 6,213,588 | 6,213,589 |
| 6,231,163 | 6,247,795 | 6,394,581 | 6,244,691 | 6,257,704 |
| 6,416,168 | 6,220,694 | 6,257,705 | 6,247,794 | 6,234,610 |
| 6,247,793 | 6,264,306 | 6,241,342 | 6,247,792 | 6,264,307 |
| 6,254,220 | 6,234,611 | 6,302,528 | 6,283,582 | 6,239,821 |
| 6,338,547 | 6,247,796 | 6,557,977 | 6,390,603 | 6,362,843 |
| 6,293,653 | 6,312,107 | 6,227,653 | 6,234,609 | 6,238,040 |
| 6,188,415 | 6,227,654 | 6,209,989 | 6,247,791 | 6,336,710 |
| 6,217,153 | 6,416,167 | 6,243,113 | 6,283,581 | 6,247,790 |
| 6,260,953 | 6,267,469 | 6,588,882 | 6,742,873 | 6,918,655 |
| 6,547,371 | 6,938,989 | 6,598,964 | 6,923,526 | 6,273,544 |
| 6,309,048 | 6,420,196 | 6,443,558 | 6,439,689 | 6,378,989 |
| 6,848,181 | 6,634,735 | 6,299,289 | 6,299,290 | 6,425,654 |
| 6,902,255 | 6,623,101 | 6,406,129 | 6,505,916 | 6,457,809 |
| 6,550,895 | 6,457,812 | 7,152,962 | 6,428,133 | 7,216,956 |
| 7,080,895 | 7,442,317 | 7,182,437 | 7,357,485 | 7,387,368 |
| 11/607,976 | 7,618,124 | 7,654,641 | 11/607,980 | 7,611,225 |
| 11/607,978 | 7,748,827 | 7,735,970 | 7,637,582 | 7,419,247 |
| 7,384,131 | 11/763,446 | 6,224,780 | 6,235,212 | 6,280,643 |
| 6,284,147 | 6,214,244 | 6,071,750 | 6,267,905 | 6,251,298 |
| 6,258,285 | 6,225,138 | 6,241,904 | 6,299,786 | 6,866,789 |
| 6,231,773 | 6,190,931 | 6,248,249 | 6,290,862 | 6,241,906 |
| 6,565,762 | 6,241,905 | 6,451,216 | 6,231,772 | 6,274,056 |
| 6,290,861 | 6,248,248 | 6,306,671 | 6,331,258 | 6,110,754 |
| 6,294,101 | 6,416,679 | 6,264,849 | 6,254,793 | 6,245,246 |
| 6,855,264 | 6,235,211 | 6,491,833 | 6,264,850 | 6,258,284 |
| 6,312,615 | 6,228,668 | 6,180,427 | 6,171,875 | 6,267,904 |
| 6,245,247 | 6,315,914 | 7,169,316 | 6,526,658 | 7,210,767 |
| 7,390,421 | 7,547,095 | 6,665,094 | 6,450,605 | 6,512,596 |
| 6,654,144 | 7,125,090 | 6,687,022 | 7,072,076 | 7,092,125 |
| 7,215,443 | 7,136,195 | 7,077,494 | 6,877,834 | 6,969,139 |
| 7,469,983 | 7,283,280 | 6,912,067 | 7,277,205 | 7,154,637 |
| 7,591,522 | 7,070,251 | 6,851,782 | 10/636,211 | 6,843,545 |
| 7,079,286 | 7,064,867 | 7,065,247 | 7,027,177 | 7,218,415 |
| 7,064,873 | 6,954,276 | 7,061,644 | 7,092,127 | 7,059,695 |
| 7,537,297 | 7,177,052 | 7,270,394 | 7,463,373 | 7,188,921 |
| 7,187,469 | 7,196,820 | 7,429,092 | 7,283,281 | 7,251,051 |
| 7,245,399 | 7,413,273 | 7,372,598 | 7,382,488 | 7,365,874 |
| 7,349,125 | 7,336,397 | 11/834,637 | 7,456,996 | 7,571,541 |
| 7,736,458 | 11/305,275 | 11/305,152 | 7,416,629 | 7,469,987 |
| 6,231,148 | 6,293,658 | 6,614,560 | 6,238,033 | 6,312,070 |
| 6,238,111 | 6,378,970 | 6,196,739 | 6,270,182 | 6,152,619 |
| 7,006,143 | 6,876,394 | 6,738,096 | 6,970,186 | 6,287,028 |
| 6,412,993 | 11/033,145 | 7,466,341 | 7,477,287 | 11/672,878 |
| 7,204,941 | 7,282,164 | 7,465,342 | 11/845,672 | 7,278,727 |
| 7,417,141 | 7,452,989 | 7,367,665 | 7,138,391 | 7,153,956 |
| 7,423,145 | 7,456,277 | 7,550,585 | 7,122,076 | 7,148,345 |
| 7,470,315 | 7,572,327 | 7,658,792 | 7,709,633 | 11/482,985 |
| 11/454,899 | 11/583,942 | 7,559,983 | 7,671,194 | 11/831,962 |
| 11/831,963 | 7,699,920 | 7,750,147 | 7,416,280 | 7,252,366 |
| 7,488,051 | 7,360,865 | 7,275,811 | 7,628,468 | 7,334,874 |
| 7,393,083 | 7,475,965 | 7,578,582 | 7,591,539 | 10/922,887 |
| 7,472,984 | 7,753,469 | 7,234,795 | 7,401,884 | 7,328,975 |
| 7,293,855 | 7,410,250 | 7,401,900 | 7,527,357 | 7,410,243 |
| 7,360,871 | 7,661,793 | 7,708,372 | 7,147,792 | 7,175,774 |
| 7,404,625 | 7,350,903 | 11/766,713 | 7,631,956 | 7,733,535 |
| 11/563,684 | 11/482,967 | 11/482,966 | 11/482,988 | 7,681,000 |
| 7,438,371 | 7,465,017 | 7,441,862 | 7,654,636 | 7,458,659 |
| 7,455,376 | 11/124,158 | 11/124,196 | 11/124,199 | 11/124,162 |
| 11/124,202 | 7,735,993 | 11/124,198 | 7,284,921 | 11/124,151 |
| 7,407,257 | 7,470,019 | 7,645,022 | 7,392,950 | 11/124,149 |
| 7,360,880 | 7,517,046 | 7,236,271 | 11/124,174 | 7,753,517 |

-continued

| | | | | |
|---|---|---|---|---|
| 11/124,164 | 7,465,047 | 7,607,774 | 11/124,166 | 11/124,150 |
| 11/124,172 | 7,566,182 | 11/124,185 | 11/124,184 | 11/124,182 |
| 7,715,036 | 11/124,171 | 11/124,181 | 7,697,159 | 7,595,904 |
| 7,726,764 | 11/124,159 | 7,466,993 | 7,370,932 | 7,404,616 |
| 11/124,187 | 7,740,347 | 11/124,190 | 7,500,268 | 7,558,962 |
| 7,447,908 | 11/124,178 | 7,661,813 | 7,456,994 | 7,431,449 |
| 7,466,444 | 11/124,179 | 7,680,512 | 11/187,976 | 11/188,011 |
| 7,562,973 | 7,530,446 | 7,628,467 | 7,572,077 | 7,465,048 |
| 7,761,090 | 11/228,500 | 7,668,540 | 7,738,862 | 11/228,490 |
| 11/228,531 | 11/228,504 | 7,738,919 | 11/228,507 | 7,708,203 |
| 11/228,505 | 7,641,115 | 7,697,714 | 7,654,444 | 11/228,484 |
| 7,499,765 | 11/228,518 | 7,756,526 | 11/228,496 | 7,558,563 |
| 11/228,506 | 11/228,516 | 11/228,526 | 7,747,280 | 7,742,755 |
| 7,738,674 | 11/228,523 | 7,506,802 | 7,724,399 | 11/228,527 |
| 7,403,797 | 11/228,520 | 7,646,503 | 11/228,511 | 7,672,664 |
| 11/228,515 | 11/228,537 | 11/228,534 | 11/228,491 | 11/228,499 |
| 11/228,509 | 11/228,492 | 7,558,599 | 11/228,510 | 11/228,508 |
| 11/228,512 | 11/228,514 | 11/228,494 | 7,438,215 | 7,689,249 |
| 7,621,442 | 7,575,172 | 7,357,311 | 7,380,709 | 7,428,986 |
| 7,403,796 | 7,407,092 | 11/228,513 | 7,637,424 | 7,469,829 |
| 11/228,535 | 7,558,597 | 7,558,598 | 6,238,115 | 6,386,535 |
| 6,398,344 | 6,612,240 | 6,752,549 | 6,805,049 | 6,971,313 |
| 6,899,480 | 6,860,664 | 6,925,935 | 6,966,636 | 7,024,995 |
| 7,284,852 | 6,926,455 | 7,056,038 | 6,869,172 | 7,021,843 |
| 6,988,845 | 6,964,533 | 6,981,809 | 7,284,822 | 7,258,067 |
| 7,322,757 | 7,222,941 | 7,284,925 | 7,278,795 | 7,249,904 |
| 7,364,286 | 7,677,682 | 11/863,246 | 11/863,145 | 11/865,650 |
| 6,087,638 | 6,340,222 | 6,041,600 | 6,299,300 | 6,067,797 |
| 6,286,935 | 6,044,646 | 6,382,769 | 6,787,051 | 6,938,990 |
| 7,588,693 | 7,416,282 | 7,481,943 | 11/861,282 | 11/861,284 |
| 7,678,667 | 7,152,972 | 7,513,615 | 6,390,605 | 6,322,195 |
| 6,612,110 | 6,480,089 | 6,460,778 | 6,305,788 | 6,426,014 |
| 6,364,453 | 6,457,795 | 6,315,399 | 6,338,548 | 7,040,736 |
| 6,938,992 | 6,994,425 | 6,863,379 | 6,540,319 | 6,994,421 |
| 6,984,019 | 7,008,043 | 6,997,544 | 6,328,431 | 6,991,310 |
| 7,465,007 | 7,140,723 | 6,328,425 | 6,982,184 | 7,267,423 |
| 7,134,741 | 7,066,577 | 7,152,945 | 7,303,689 | 7,021,744 |
| 6,991,320 | 7,155,911 | 7,464,547 | 6,595,624 | 7,152,943 |
| 7,125,103 | 7,328,971 | 7,290,857 | 7,285,437 | 7,229,151 |
| 7,341,331 | 7,237,873 | 11/329,163 | 7,545,251 | 7,465,405 |
| 7,213,907 | 6,417,757 | 7,581,819 | 7,695,108 | 7,530,669 |
| 7,556,344 | 7,387,364 | 7,517,037 | 7,467,851 | 7,654,638 |
| 7,556,348 | 7,581,817 | 7,481,518 | 11/869,670 | 7,095,309 |
| 6,854,825 | 6,623,106 | 6,672,707 | 6,575,561 | 6,817,700 |
| 6,588,885 | 7,075,677 | 6,428,139 | 6,575,549 | 6,846,692 |
| 6,425,971 | 7,063,993 | 6,383,833 | 6,955,414 | 6,412,908 |
| 6,746,105 | 6,953,236 | 6,412,904 | 7,128,388 | 6,398,343 |
| 6,652,071 | 6,793,323 | 6,659,590 | 6,676,245 | 7,201,460 |
| 6,464,332 | 6,659,593 | 6,478,406 | 6,978,613 | 6,439,693 |
| 6,502,306 | 6,966,111 | 6,863,369 | 6,428,142 | 6,874,868 |
| 6,390,591 | 6,799,828 | 6,896,358 | 7,018,016 | 7,380,905 |
| 6,328,417 | 6,322,194 | 6,382,779 | 6,629,745 | 6,565,193 |
| 6,609,786 | 6,609,787 | 6,439,908 | 6,684,503 | 6,843,551 |
| 6,764,166 | 6,561,617 | 7,328,967 | 6,557,970 | 6,546,628 |
| 7,407,269 | 6,652,074 | 6,820,968 | 7,175,260 | 6,682,174 |
| 7,303,262 | 6,648,453 | 6,834,932 | 6,682,176 | 6,998,062 |
| 6,767,077 | 7,278,717 | 6,755,509 | 7,347,537 | 6,692,108 |
| 7,407,271 | 6,672,709 | 7,303,263 | 7,086,718 | 7,429,097 |
| 6,672,710 | 7,465,034 | 6,669,334 | 7,322,686 | 7,152,958 |
| 7,281,782 | 6,824,246 | 7,264,336 | 6,669,333 | 7,357,489 |
| 6,820,967 | 7,306,326 | 6,736,489 | 7,264,335 | 6,719,406 |
| 7,222,943 | 7,188,419 | 7,168,166 | 6,974,209 | 7,086,719 |
| 6,974,210 | 7,195,338 | 7,252,775 | 7,101,025 | 7,597,423 |
| 7,533,963 | 7,469,995 | 7,587,823 | 7,587,822 | 7,658,472 |
| 7,401,903 | 7,416,284 | 7,722,168 | 7,744,191 | 7,441,876 |
| 7,543,914 | 11/763,440 | 11/763,442 | 7,744,195 | 7,645,026 |
| 7,322,681 | 7,708,387 | 7,753,496 | 7,712,884 | 7,510,267 |
| 7,465,041 | 11/246,712 | 7,465,032 | 7,401,890 | 7,401,910 |
| 7,470,010 | 7,735,971 | 7,431,432 | 7,465,037 | 7,445,317 |
| 7,549,735 | 7,597,425 | 7,661,800 | 7,712,869 | 7,712,876 |
| 7,712,859 | 11/829,961 | 11/829,962 | 11/829,963 | 11/829,966 |
| 11/829,967 | 11/829,968 | 11/829,969 | 7,156,508 | 7,159,972 |
| 7,083,271 | 7,165,834 | 7,080,894 | 7,201,469 | 7,090,336 |
| 7,156,489 | 7,413,283 | 7,438,385 | 7,083,257 | 7,258,422 |
| 7,255,423 | 7,219,980 | 7,591,533 | 7,416,274 | 7,367,649 |
| 7,118,192 | 7,618,121 | 7,322,672 | 7,077,505 | 7,198,354 |
| 7,077,504 | 7,614,724 | 7,198,355 | 7,401,894 | 7,322,676 |
| 7,152,959 | 7,213,906 | 7,178,901 | 7,222,938 | 7,108,353 |
| 7,104,629 | 7,455,392 | 7,370,939 | 7,429,095 | 7,404,621 |

-continued

| | | | | |
|---|---|---|---|---|
| 7,261,401 | 7,461,919 | 7,438,388 | 7,328,972 | 7,322,673 |
| 7,306,324 | 7,306,325 | 7,524,021 | 7,399,071 | 7,556,360 |
| 7,303,261 | 7,568,786 | 7,517,049 | 7,549,727 | 7,399,053 |
| 7,467,849 | 7,556,349 | 7,648,226 | 7,726,790 | 7,404,623 |
| 7,303,930 | 7,401,405 | 7,464,466 | 7,464,465 | 11/860,538 |
| 11/860,539 | 11/860,540 | 7,659,141 | 7,618,842 | 7,638,349 |
| 11/877,667 | 7,658,977 | 7,246,886 | 7,128,400 | 7,108,355 |
| 6,991,322 | 7,287,836 | 7,118,197 | 7,575,298 | 7,364,269 |
| 7,077,493 | 6,962,402 | 7,686,429 | 7,147,308 | 7,524,034 |
| 7,118,198 | 7,168,790 | 7,172,270 | 7,229,155 | 6,830,318 |
| 7,195,342 | 7,175,261 | 7,465,035 | 7,108,356 | 7,118,202 |
| 7,510,269 | 7,134,744 | 7,510,270 | 7,134,743 | 7,182,439 |
| 7,210,768 | 7,465,036 | 7,134,745 | 7,156,484 | 7,118,201 |
| 7,111,926 | 7,431,433 | 7,018,021 | 7,401,901 | 7,468,139 |
| 7,128,402 | 7,387,369 | 7,484,832 | 11/490,041 | 7,506,968 |
| 7,284,839 | 7,246,885 | 7,229,156 | 7,533,970 | 7,467,855 |
| 7,293,858 | 7,520,594 | 7,588,321 | 7,258,427 | 7,556,350 |
| 7,278,716 | 11/603,825 | 7,524,028 | 7,467,856 | 7,469,996 |
| 7,506,963 | 7,533,968 | 7,556,354 | 7,524,030 | 7,581,822 |
| 7,533,964 | 7,549,729 | 11/842,950 | 7,543,916 | 7,717,543 |
| 7,448,729 | 7,246,876 | 7,431,431 | 7,419,249 | 7,377,623 |
| 7,328,978 | 7,334,876 | 7,147,306 | 7,261,394 | 7,611,218 |
| 7,637,593 | 7,654,645 | 11/482,977 | 7,491,911 | 11/764,808 |
| 7,376,273 | 11/756,625 | 7,738,744 | 7,400,769 | 11/756,628 |
| 11/756,629 | 7,568,622 | 11/756,631 | 7,466,440 | 7,249,901 |
| 7,477,987 | 11/478,590 | 7,503,493 | 7,156,289 | 7,178,718 |
| 7,225,979 | 7,380,712 | 7,540,429 | 7,584,402 | 11/084,806 |
| 7,721,948 | 7,079,712 | 6,825,945 | 7,330,974 | 6,813,039 |
| 7,190,474 | 6,987,506 | 6,824,044 | 7,038,797 | 6,980,318 |
| 6,816,274 | 7,102,772 | 7,350,236 | 6,681,045 | 6,678,499 |
| 6,679,420 | 6,963,845 | 6,976,220 | 6,728,000 | 7,110,126 |
| 7,173,722 | 6,976,035 | 6,813,558 | 6,766,942 | 6,965,454 |
| 6,995,859 | 7,088,459 | 6,720,985 | 7,286,113 | 6,922,779 |
| 6,978,019 | 6,847,883 | 7,131,058 | 7,295,839 | 7,406,445 |
| 7,533,031 | 6,959,298 | 6,973,450 | 7,150,404 | 6,965,882 |
| 7,233,924 | 7,707,082 | 7,593,899 | 7,175,079 | 7,162,259 |
| 6,718,061 | 7,464,880 | 7,012,710 | 6,825,956 | 7,451,115 |
| 7,222,098 | 7,590,561 | 7,263,508 | 7,031,010 | 6,972,864 |
| 6,862,105 | 7,009,738 | 6,989,911 | 6,982,807 | 7,518,756 |
| 6,829,387 | 6,714,678 | 6,644,545 | 6,609,653 | 6,651,879 |
| 10/291,555 | 7,293,240 | 7,467,185 | 7,415,668 | 7,044,363 |
| 7,004,390 | 6,867,880 | 7,034,953 | 6,987,581 | 7,216,224 |
| 7,506,153 | 7,162,269 | 7,162,222 | 7,290,210 | 7,293,233 |
| 7,293,234 | 6,850,931 | 6,865,570 | 6,847,961 | 10/685,583 |
| 7,162,442 | 10/685,584 | 7,159,784 | 7,557,944 | 7,404,144 |
| 6,889,896 | 7,174,056 | 6,996,274 | 7,162,088 | 7,388,985 |
| 7,417,759 | 7,362,463 | 7,259,884 | 7,167,270 | 7,388,685 |
| 6,986,459 | 10/954,170 | 7,181,448 | 7,590,622 | 7,657,510 |
| 7,324,989 | 7,231,293 | 7,174,329 | 7,369,261 | 7,295,922 |
| 7,200,591 | 7,693,828 | 11/020,260 | 11/020,321 | 11/020,319 |
| 7,466,436 | 7,347,357 | 11/051,032 | 7,382,482 | 7,602,515 |
| 7,446,893 | 11/082,940 | 11/082,815 | 7,389,423 | 7,401,227 |
| 6,991,153 | 6,991,154 | 7,589,854 | 7,551,305 | 7,322,524 |
| 7,408,670 | 7,466,439 | 11/206,778 | 7,571,193 | 11/222,977 |
| 7,327,485 | 7,428,070 | 7,225,402 | 7,577,428 | 11/349,143 |
| 7,450,264 | 7,580,698 | 11/442,428 | 11/454,902 | 7,271,931 |
| 11/520,170 | 7,430,058 | 7,760,371 | 11/739,032 | 7,421,337 |
| 7,336,389 | 7,539,937 | 11/830,849 | 7,460,713 | 11/866,394 |
| 7,757,090 | 7,068,382 | 7,007,851 | 6,957,921 | 6,457,883 |
| 7,044,381 | 11/203,205 | 7,094,910 | 7,091,344 | 7,122,685 |
| 7,038,066 | 7,099,019 | 7,062,651 | 6,789,194 | 6,789,191 |
| 7,529,936 | 7,278,018 | 7,360,089 | 7,526,647 | 7,467,416 |
| 6,644,642 | 6,502,614 | 6,622,999 | 6,669,385 | 6,827,116 |
| 7,011,128 | 7,416,009 | 6,549,935 | 6,987,573 | 6,727,996 |
| 6,591,884 | 6,439,706 | 6,760,119 | 7,295,332 | 7,064,851 |
| 6,826,547 | 6,290,349 | 6,428,155 | 6,785,016 | 6,831,682 |
| 6,741,871 | 6,927,871 | 6,980,306 | 6,965,439 | 6,840,606 |
| 7,036,918 | 6,977,746 | 6,970,264 | 7,068,389 | 7,093,991 |
| 7,190,491 | 7,511,847 | 7,663,780 | 10/962,412 | 7,177,054 |
| 7,364,282 | 10/965,733 | 10/965,933 | 7,728,872 | 7,468,809 |
| 7,180,609 | 7,538,793 | 7,466,438 | 7,292,363 | 7,515,292 |
| 7,576,876 | 7,414,741 | 7,202,959 | 11/653,219 | 7,728,991 |
| 7,573,588 | 7,466,434 | 7,688,457 | 6,982,798 | 6,870,966 |
| 6,822,639 | 6,474,888 | 6,627,870 | 6,724,374 | 6,788,982 |
| 7,263,270 | 6,788,293 | 6,946,672 | 6,737,591 | 7,091,960 |
| 6,792,165 | 7,105,753 | 6,795,593 | 6,980,704 | 6,768,821 |
| 7,132,612 | 7,041,916 | 6,797,895 | 7,015,901 | 7,289,882 |
| 7,148,644 | 10/778,056 | 10/778,058 | 10/778,060 | 7,515,186 |
| 7,567,279 | 10/778,062 | 7,096,199 | 7,286,887 | 7,400,937 |

-continued

| | | | | |
|---|---|---|---|---|
| 7,474,930 | 7,324,859 | 7,218,978 | 7,245,294 | 7,277,085 |
| 7,187,370 | 7,609,410 | 7,660,490 | 10/919,379 | 7,019,319 |
| 7,593,604 | 7,660,489 | 7,043,096 | 7,148,499 | 7,463,250 |
| 7,590,311 | 11/155,557 | 11/193,481 | 7,567,241 | 11/193,482 |
| 11/193,479 | 7,336,267 | 7,388,221 | 7,577,317 | 7,245,760 |
| 7,649,523 | 11/495,814 | 11/495,823 | 7,657,128 | 7,523,672 |
| 11/495,820 | 11/653,242 | 7,358,697 | 11/829,936 | 11/839,494 |
| 7,650,197 | 7,533,816 | 7,613,533 | 11/866,336 | 7,580,764 |
| 7,580,765 | 7,055,739 | 7,233,320 | 6,830,196 | 6,832,717 |
| 7,182,247 | 7,120,853 | 7,082,562 | 6,843,420 | 10/291,718 |
| 6,789,731 | 7,057,608 | 6,766,944 | 6,766,945 | 7,289,103 |
| 7,412,651 | 7,299,969 | 7,264,173 | 7,108,192 | 7,549,595 |
| 7,111,791 | 7,077,333 | 6,983,878 | 7,564,605 | 7,134,598 |
| 7,431,219 | 6,929,186 | 6,994,264 | 7,017,826 | 7,014,123 |
| 7,134,601 | 7,150,396 | 7,469,830 | 7,017,823 | 7,025,276 |
| 7,284,701 | 7,080,780 | 7,376,884 | 7,334,739 | 7,380,727 |
| 11/842,948 | 10/492,169 | 7,469,062 | 7,359,551 | 7,444,021 |
| 7,308,148 | 7,630,962 | 10/531,229 | 7,630,553 | 7,630,554 |
| 10/510,391 | 7,660,466 | 7,526,128 | 7,630,551 | 7,463,779 |
| 6,957,768 | 7,456,820 | 7,170,499 | 7,106,888 | 7,123,239 |
| 6,982,701 | 6,982,703 | 7,227,527 | 6,786,397 | 6,947,027 |
| 6,975,299 | 7,139,431 | 7,048,178 | 7,118,025 | 6,839,053 |
| 7,015,900 | 7,010,147 | 7,133,557 | 6,914,593 | 7,437,671 |
| 6,938,826 | 7,278,566 | 7,123,245 | 6,992,662 | 7,190,346 |
| 7,417,629 | 7,468,724 | 7,382,354 | 7,715,035 | 7,221,781 |
| 11/102,843 | 7,213,756 | 7,362,314 | 7,180,507 | 7,263,225 |
| 7,287,688 | 7,530,501 | 7,751,090 | 11/782,596 | 11/865,711 |
| 11/856,061 | 11/856,062 | 11/856,064 | 11/856,066 | 11/672,522 |
| 11/672,950 | 11/672,947 | 11/672,891 | 7,760,969 | 11/672,533 |
| 11/754,310 | 11/754,321 | 11/754,320 | 11/754,319 | 11/754,318 |
| 11/754,317 | 11/754,316 | 11/754,315 | 11/754,314 | 11/754,313 |
| 11/754,312 | 11/754,311 | 6,593,166 | 7,132,679 | 6,940,088 |
| 7,119,357 | 7,307,272 | 6,755,513 | 6,974,204 | 6,409,323 |
| 7,055,930 | 6,281,912 | 6,893,109 | 6,604,810 | 6,824,242 |
| 6,318,920 | 7,210,867 | 6,488,422 | 6,655,786 | 6,457,810 |
| 6,485,135 | 6,796,731 | 6,904,678 | 6,641,253 | 7,125,106 |
| 6,786,658 | 7,097,273 | 6,824,245 | 7,222,947 | 6,918,649 |
| 6,860,581 | 6,929,351 | 7,063,404 | 6,969,150 | 7,004,652 |
| 6,871,938 | 6,905,194 | 6,846,059 | 6,997,626 | 7,303,256 |
| 7,029,098 | 6,966,625 | 7,114,794 | 7,207,646 | 7,077,496 |
| 7,284,831 | 7,357,484 | 7,152,938 | 7,182,434 | 7,182,430 |
| 7,306,317 | 7,032,993 | 7,325,905 | 7,407,259 | 7,357,475 |
| 7,172,266 | 7,258,430 | 7,128,392 | 7,210,866 | 7,306,322 |
| 7,591,529 | 7,384,127 | 7,427,123 | 7,354,208 | 7,416,272 |
| 7,416,277 | 7,357,583 | 7,712,866 | 7,758,181 | 11/782,589 |
| 7,690,761 | 11/940,302 | 7,455,391 | 7,468,284 | 7,341,330 |
| 7,372,145 | 7,425,052 | 7,287,831 | 7,510,268 | 6,804,030 |
| 6,807,315 | 6,771,811 | 6,683,996 | 7,271,936 | 7,304,771 |
| 6,965,691 | 7,058,219 | 7,289,681 | 7,187,807 | 7,181,063 |
| 7,366,351 | 7,471,413 | 7,349,572 | 10/727,162 | 7,377,608 |
| 7,399,043 | 7,121,639 | 7,165,824 | 7,152,942 | 10/727,157 |
| 7,181,572 | 7,096,137 | 7,302,592 | 7,278,034 | 7,188,282 |
| 7,592,829 | 10/727,180 | 10/727,179 | 10/727,192 | 10/727,274 |
| 7,707,621 | 7,523,111 | 7,573,301 | 7,660,998 | 10/754,536 |
| 10/754,938 | 10/727,160 | 7,171,323 | 7,278,697 | 7,465,005 |
| 7,360,131 | 7,519,772 | 7,328,115 | 7,747,887 | 11/749,749 |
| 7,369,270 | 6,795,215 | 7,070,098 | 7,154,638 | 6,805,419 |
| 6,859,289 | 6,977,751 | 6,398,332 | 6,394,573 | 6,622,923 |
| 6,747,760 | 6,921,144 | 10/884,881 | 7,092,112 | 7,192,106 |
| 7,457,001 | 7,173,739 | 6,986,560 | 7,008,033 | 7,551,324 |
| 7,222,780 | 7,270,391 | 7,150,510 | 7,525,677 | 7,388,689 |
| 7,407,247 | 7,398,916 | 7,571,906 | 7,753,490 | 7,654,628 |
| 7,611,220 | 7,524,018 | 11/743,657 | 7,556,353 | 7,568,788 |
| 7,677,686 | 7,195,328 | 7,182,422 | 11/650,537 | 11/712,540 |
| 7,374,266 | 7,427,117 | 7,448,707 | 7,281,330 | 10/854,503 |
| 7,328,956 | 7,735,944 | 7,188,928 | 7,093,989 | 7,377,609 |
| 7,600,843 | 10/854,498 | 7,390,071 | 10/854,526 | 7,549,715 |
| 7,252,353 | 7,607,757 | 7,267,417 | 10/854,505 | 7,517,036 |
| 7,275,805 | 7,314,261 | 7,281,777 | 7,290,852 | 7,484,831 |
| 7,758,143 | 10/854,527 | 7,549,718 | 10/854,520 | 7,631,190 |
| 7,557,941 | 7,757,086 | 10/854,501 | 7,266,661 | 7,243,193 |
| 10/854,518 | 7,163,345 | 7,322,666 | 7,566,111 | 7,434,910 |
| 11/735,881 | 11/748,483 | 11/749,123 | 11/766,061 | 7,465,016 |
| 11/772,235 | 11/778,569 | 7,467,836 | 7,465,002 | 7,524,007 |
| 7,543,808 | 6,924,907 | 6,712,452 | 6,416,160 | 6,238,043 |
| 6,958,826 | 6,812,972 | 6,553,459 | 6,967,741 | 6,956,669 |
| 6,903,766 | 6,804,026 | 7,259,889 | 6,975,429 | 7,518,634 |
| 7,301,567 | 7,576,775 | 7,274,485 | 7,139,084 | 7,173,735 |
| 7,068,394 | 7,286,182 | 7,086,644 | 7,250,977 | 7,146,281 |

-continued

| | | | | |
|---|---|---|---|---|
| 7,023,567 | 7,136,183 | 7,083,254 | 6,796,651 | 7,061,643 |
| 7,057,758 | 6,894,810 | 6,995,871 | 7,085,010 | 7,092,126 |
| 7,123,382 | 7,061,650 | 7,466,353 | 6,986,573 | 6,974,212 |
| 7,307,756 | 7,173,737 | 7,557,828 | 7,246,868 | 7,399,076 |
| 7,137,699 | 7,576,776 | 7,148,994 | 7,077,497 | 11/176,372 |
| 7,248,376 | 11/225,158 | 7,306,321 | 7,173,729 | 7,372,601 |
| 11/478,607 | 7,426,044 | 11/545,502 | 7,517,080 | 7,468,816 |
| 7,466,452 | 7,385,713 | 7,585,067 | 7,609,397 | 11/779,884 |
| 7,468,807 | 11/872,637 | 7,715,049 | 7,448,748 | 11/544,764 |
| 11/544,765 | 11/544,772 | 11/544,774 | 11/544,775 | 7,425,048 |
| 11/544,766 | 11/544,767 | 7,384,128 | 7,604,321 | 7,722,163 |
| 7,681,970 | 7,425,047 | 7,413,288 | 7,465,033 | 7,452,055 |
| 7,470,002 | 7,722,161 | 7,475,963 | 7,448,735 | 7,465,042 |
| 7,448,739 | 7,438,399 | 11/293,794 | 7,467,853 | 7,461,922 |
| 7,465,020 | 7,722,185 | 7,461,910 | 11/293,828 | 7,270,494 |
| 7,632,032 | 7,475,961 | 7,547,088 | 7,611,239 | 7,735,955 |
| 7,758,038 | 7,681,876 | 11/293,816 | 11/838,875 | 7,703,903 |
| 7,703,900 | 7,703,901 | 7,722,170 | 11/640,359 | 11/640,360 |
| 11/640,355 | 11/679,786 | 11/872,714 | 7,448,734 | 7,425,050 |
| 7,364,263 | 7,201,468 | 7,360,868 | 7,234,802 | 7,303,255 |
| 7,287,846 | 7,156,511 | 10/760,264 | 7,258,432 | 7,097,291 |
| 7,645,025 | 10/760,248 | 7,083,273 | 7,367,647 | 7,374,355 |
| 7,441,880 | 7,547,092 | 10/760,206 | 7,513,598 | 10/760,270 |
| 7,198,352 | 7,364,264 | 7,303,251 | 7,201,470 | 7,121,655 |
| 7,293,861 | 7,232,208 | 7,328,985 | 7,344,232 | 7,083,272 |
| 7,261,400 | 7,461,914 | 7,431,441 | 7,311,387 | 7,303,258 |
| 11/706,322 | 7,517,050 | 7,708,391 | 11/749,157 | 11/779,848 |
| 7,740,340 | 11/855,152 | 11/855,151 | 7,726,776 | 11/934,780 |
| 7,513,593 | 7,621,620 | 7,669,961 | 7,331,663 | 7,360,861 |
| 7,328,973 | 7,427,121 | 7,407,262 | 7,303,252 | 7,249,822 |
| 7,537,309 | 7,311,382 | 7,360,860 | 7,364,257 | 7,390,075 |
| 7,350,896 | 7,429,096 | 7,384,135 | 7,331,660 | 7,416,287 |
| 7,488,052 | 7,322,684 | 7,322,685 | 7,311,381 | 7,270,405 |
| 7,303,268 | 7,470,007 | 7,399,072 | 7,393,076 | 7,681,967 |
| 7,588,301 | 7,249,833 | 7,547,098 | 7,703,886 | 7,467,860 |
| 7,753,507 | 7,524,016 | 7,490,927 | 7,331,661 | 7,524,043 |
| 7,300,140 | 7,357,492 | 7,357,493 | 7,566,106 | 7,380,902 |
| 7,284,816 | 7,284,845 | 7,255,430 | 7,390,080 | 7,328,984 |
| 7,350,913 | 7,322,671 | 7,380,910 | 7,431,424 | 7,470,006 |
| 7,585,054 | 7,347,534 | 7,441,865 | 7,469,989 | 7,367,650 |
| 7,726,789 | 11/852,958 | 7,748,828 | 7,549,738 | 7,469,990 |
| 7,441,882 | 7,556,364 | 7,357,496 | 7,467,863 | 7,431,440 |
| 7,431,443 | 7,527,353 | 7,524,023 | 7,513,603 | 7,467,852 |
| 7,465,045 | 11/688,863 | 11/688,864 | 7,475,976 | 7,364,265 |
| 11/688,867 | 7,758,177 | 11/688,869 | 11/688,871 | 11/688,872 |
| 7,654,640 | 7,721,441 | 7,645,034 | 7,637,602 | 7,645,033 |
| 7,661,803 | 11/495,819 | 11/677,049 | 11/677,050 | 7,658,482 |
| 11/872,719 | 11/872,718 | 7,306,320 | 7,731,327 | 7,111,935 |
| 7,562,971 | 7,735,982 | 7,604,322 | 7,261,482 | 7,002,664 |
| 10/760,252 | 7,088,420 | 11/446,233 | 7,470,014 | 7,470,020 |
| 7,540,601 | 7,654,761 | 6,364,451 | 6,533,390 | 6,454,378 |
| 7,224,478 | 6,559,969 | 6,896,362 | 7,057,760 | 6,982,799 |
| 7,528,972 | 7,649,647 | 7,649,648 | 11/743,673 | 7,093,494 |
| 7,143,652 | 7,089,797 | 7,159,467 | 7,234,357 | 7,124,643 |
| 7,121,145 | 7,089,790 | 7,194,901 | 6,968,744 | 7,089,798 |
| 7,240,560 | 7,137,302 | 7,350,417 | 7,171,855 | 7,260,995 |
| 7,260,993 | 7,165,460 | 7,222,538 | 7,258,019 | 7,549,342 |
| 7,258,020 | 7,367,235 | 7,334,480 | 7,380,460 | 7,549,328 |
| 7,461,558 | 11/767,526 | 7,458,272 | 7,430,919 | 7,568,395 |
| 7,644,621 | 6,454,482 | 6,808,330 | 6,527,365 | 6,474,773 |
| 6,550,997 | 7,093,923 | 6,957,923 | 7,131,724 | 7,396,177 |
| 7,168,867 | 7,125,098 | 7,396,178 | 7,413,363 | 7,188,930 |
| 7,377,635 | 7,686,446 | 7,237,888 | 7,168,654 | 7,201,272 |
| 6,991,098 | 7,217,051 | 6,944,970 | 10/760,215 | 7,108,434 |
| 7,210,407 | 7,186,042 | 10/760,266 | 6,920,704 | 7,217,049 |
| 7,607,756 | 7,147,102 | 7,287,828 | 7,249,838 | 10/760,241 |
| 7,431,446 | 7,611,237 | 7,261,477 | 7,225,739 | 7,712,886 |
| 7,665,836 | 7,419,053 | 7,191,978 | 10/962,426 | 7,524,046 |
| 10/962,417 | 10/962,403 | 7,163,287 | 7,258,415 | 7,322,677 |
| 7,258,424 | 7,484,841 | 7,195,412 | 7,207,670 | 7,270,401 |
| 7,220,072 | 7,588,381 | 7,726,785 | 11/585,925 | 7,578,387 |
| 11/706,298 | 7,575,316 | 7,384,206 | 7,628,557 | 7,470,074 |
| 7,425,063 | 7,429,104 | 7,556,446 | 7,367,267 | 11/754,359 |
| 11/778,061 | 11/765,398 | 11/778,556 | 7,448,551 | 7,399,065 |
| 7,695,204 | 7,322,761 | 11/223,021 | 7,735,994 | 6,716,666 |
| 6,949,217 | 6,750,083 | 7,014,451 | 6,777,259 | 6,923,524 |
| 6,557,978 | 6,991,207 | 6,766,998 | 6,967,354 | 6,759,723 |
| 6,870,259 | 10/853,270 | 6,925,875 | 7,618,575 | 7,095,109 |
| 7,145,696 | 7,461,931 | 7,193,482 | 7,134,739 | 7,222,939 |

-continued

| | | | | |
|---|---|---|---|---|
| 7,164,501 | 7,118,186 | 7,201,523 | 7,226,159 | 7,249,839 |
| 7,108,343 | 7,154,626 | 7,079,292 | 7,580,068 | 7,233,421 |
| 7,063,408 | 7,377,706 | 7,572,000 | 7,032,996 | 7,533,022 |
| 7,605,851 | 7,349,216 | 7,217,046 | 6,948,870 | 7,195,336 |
| 7,070,257 | 7,669,965 | 7,677,687 | 7,093,922 | 6,988,789 |
| 7,371,024 | 7,246,871 | 7,612,825 | 7,441,866 | 7,187,468 |
| 7,196,814 | 7,372,593 | 7,268,911 | 7,265,869 | 7,128,384 |
| 7,164,505 | 7,284,805 | 7,025,434 | 7,298,519 | 7,280,244 |
| 7,206,098 | 7,265,877 | 7,193,743 | 7,168,777 | 11/006,734 |
| 7,195,329 | 7,198,346 | 7,281,786 | 7,518,642 | 11/013,881 |
| 6,959,983 | 7,128,386 | 7,097,104 | 7,350,889 | 7,083,261 |
| 7,070,258 | 7,083,275 | 7,110,139 | 6,994,419 | 6,935,725 |
| 7,398,597 | 7,178,892 | 7,219,429 | 6,988,784 | 7,604,345 |
| 7,289,156 | 7,407,614 | 7,284,976 | 7,178,903 | 7,273,274 |
| 7,083,256 | 7,325,986 | 7,278,707 | 7,325,918 | 6,974,206 |
| 7,364,258 | 7,066,588 | 7,222,940 | 7,543,924 | 7,018,025 |
| 7,221,867 | 7,290,863 | 7,188,938 | 7,021,742 | 7,083,262 |
| 7,192,119 | 7,073,892 | 7,036,912 | 7,175,256 | 7,182,441 |
| 7,083,258 | 7,114,796 | 7,147,302 | 7,380,906 | 7,219,982 |
| 7,118,195 | 7,229,153 | 6,991,318 | 7,108,346 | 7,556,370 |
| 7,404,617 | 7,178,899 | 7,066,579 | 7,425,053 | 7,441,885 |
| 11/329,140 | 7,270,397 | 7,258,425 | 7,237,874 | 7,152,961 |
| 7,333,235 | 7,207,658 | 7,465,013 | 7,311,257 | 7,207,659 |
| 7,497,555 | 7,540,592 | 7,540,602 | 7,400,419 | 7,524,026 |
| 7,306,307 | 11/604,316 | 7,433,073 | 7,537,325 | 7,537,317 |
| 7,329,061 | 7,549,726 | 7,677,698 | 7,278,713 | 7,391,531 |
| 7,419,244 | 7,566,125 | 7,467,903 | 7,290,853 | 7,581,831 |
| 7,506,964 | 11/737,139 | 7,556,347 | 7,387,365 | 11/749,122 |
| 7,753,503 | 7,567,363 | 7,540,582 | 11/768,872 | 7,717,538 |
| 7,468,808 | 7,401,902 | 11/829,938 | 11/858,852 | 7,690,765 |
| 7,753,504 | 7,669,952 | 7,621,607 | 6,485,123 | 6,425,657 |
| 6,488,358 | 7,021,746 | 6,712,986 | 6,981,757 | 6,505,912 |
| 6,439,694 | 6,364,461 | 6,378,990 | 6,425,658 | 6,488,361 |
| 6,814,429 | 6,471,336 | 6,457,813 | 6,540,331 | 6,454,396 |
| 6,464,325 | 6,443,559 | 6,435,664 | 6,412,914 | 6,488,360 |
| 6,550,896 | 6,439,695 | 6,447,100 | 7,381,340 | 6,488,359 |
| 6,637,873 | 7,443,434 | 6,618,117 | 6,803,989 | 7,234,801 |
| 7,044,589 | 7,163,273 | 6,416,154 | 6,547,364 | 7,722,172 |
| 6,644,771 | 7,152,939 | 6,565,181 | 7,325,897 | 6,857,719 |
| 7,255,414 | 6,702,417 | 7,284,843 | 6,918,654 | 7,070,265 |
| 6,616,271 | 6,652,078 | 6,503,408 | 6,607,263 | 7,111,924 |
| 6,623,108 | 6,698,867 | 6,488,362 | 6,625,874 | 6,921,153 |
| 7,198,356 | 6,536,874 | 6,425,651 | 6,435,667 | 10/509,997 |
| 6,527,374 | 7,334,873 | 6,582,059 | 7,631,957 | 6,513,908 |
| 7,246,883 | 6,540,332 | 6,547,368 | 7,070,256 | 6,508,546 |
| 7,758,142 | 6,679,584 | 7,303,254 | 6,857,724 | 7,753,463 |
| 6,652,052 | 10/509,999 | 6,672,706 | 7,661,792 | 6,688,719 |
| 6,712,924 | 6,588,886 | 7,077,508 | 7,207,654 | 6,935,724 |
| 6,927,786 | 6,988,787 | 6,899,415 | 6,672,708 | 6,644,767 |
| 6,874,866 | 6,830,316 | 6,994,420 | 6,954,254 | 7,086,720 |
| 7,240,992 | 7,267,424 | 7,128,397 | 7,084,951 | 7,156,496 |
| 7,066,578 | 7,101,023 | 7,431,427 | 7,452,048 | 7,399,063 |
| 7,159,965 | 7,255,424 | 7,581,826 | 7,137,686 | 7,201,472 |
| 7,287,829 | 11/504,602 | 7,216,957 | 7,483,053 | 7,461,923 |
| 7,517,071 | 7,506,961 | 7,278,712 | 7,524,033 | 7,465,025 |
| 7,287,827 | 11/944,451 | 7,575,313 | 7,364,271 | 7,556,355 |
| 7,566,113 | 7,524,031 | 11/863,260 | 11/874,178 | 11/936,064 |
| 6,916,082 | 6,786,570 | 7,407,261 | 6,848,780 | 6,966,633 |
| 7,179,395 | 6,969,153 | 6,979,075 | 7,132,056 | 6,832,828 |
| 6,860,590 | 6,905,620 | 6,786,574 | 6,824,252 | 7,097,282 |
| 6,997,545 | 6,971,734 | 6,918,652 | 6,978,990 | 6,863,105 |
| 7,454,617 | 7,194,629 | 10/791,792 | 6,890,059 | 6,988,785 |
| 6,830,315 | 7,246,881 | 7,125,102 | 7,028,474 | 7,066,575 |
| 6,986,202 | 7,044,584 | 7,210,762 | 7,032,992 | 7,140,720 |
| 7,207,656 | 7,285,170 | 7,416,275 | 7,008,041 | 7,011,390 |
| 7,048,868 | 7,014,785 | 7,131,717 | 7,284,826 | 7,331,101 |
| 7,182,436 | 7,104,631 | 7,240,993 | 7,290,859 | 7,556,358 |
| 7,172,265 | 7,284,837 | 7,066,573 | 7,364,270 | 7,152,949 |
| 7,334,877 | 7,380,913 | 7,326,357 | 7,156,492 | 7,566,110 |
| 7,331,653 | 7,287,834 | 7,637,594 | 7,413,671 | 7,571,983 |
| 7,284,326 | 7,524,027 | 7,556,352 | 7,604,314 | 7,585,050 |
| 7,591,534 | 7,537,301 | 7,588,316 | 7,722,162 | 11/865,668 |
| 11/874,168 | 7,467,850 | 6,824,257 | 7,270,475 | 6,971,811 |
| 6,878,564 | 6,921,145 | 6,890,052 | 7,021,747 | 6,929,345 |
| 6,811,242 | 6,916,087 | 6,905,195 | 6,899,416 | 6,883,906 |
| 6,955,428 | 7,284,834 | 6,932,459 | 6,962,410 | 7,033,008 |
| 6,962,409 | 7,013,641 | 7,204,580 | 7,032,997 | 6,998,278 |
| 7,004,563 | 6,910,755 | 6,969,142 | 6,938,994 | 7,188,935 |
| 7,380,339 | 7,134,740 | 6,997,537 | 7,004,567 | 6,916,091 |

-continued

| | | | | |
|---|---|---|---|---|
| 7,077,588 | 6,918,707 | 6,923,583 | 6,953,295 | 6,921,221 |
| 7,001,008 | 7,168,167 | 7,210,759 | 7,337,532 | 7,331,659 |
| 7,322,680 | 6,988,790 | 7,192,120 | 7,168,789 | 7,004,577 |
| 7,052,120 | 6,994,426 | 7,258,418 | 7,014,298 | 7,328,977 |
| 7,370,941 | 7,152,955 | 7,097,292 | 7,207,657 | 7,152,944 |
| 7,147,303 | 7,338,147 | 7,134,608 | 7,264,333 | 7,093,921 |
| 7,077,590 | 7,147,297 | 7,387,363 | 7,380,908 | 7,387,573 |
| 7,077,507 | 7,172,672 | 7,175,776 | 7,086,717 | 7,101,020 |
| 7,347,535 | 7,201,466 | 7,404,620 | 7,152,967 | 7,182,431 |
| 7,210,666 | 7,252,367 | 7,287,837 | 7,467,842 | 7,374,695 |
| 6,945,630 | 7,018,294 | 6,910,014 | 6,659,447 | 6,648,321 |
| 7,082,980 | 6,672,584 | 7,073,551 | 6,830,395 | 7,289,727 |
| 7,001,011 | 6,880,922 | 6,886,915 | 6,644,787 | 6,641,255 |
| 7,066,580 | 6,652,082 | 7,284,833 | 6,666,544 | 6,666,543 |
| 6,669,332 | 6,984,023 | 6,733,104 | 6,644,793 | 6,723,575 |
| 6,953,235 | 6,663,225 | 7,076,872 | 7,059,706 | 7,185,971 |
| 7,090,335 | 6,854,827 | 6,793,974 | 10/636,258 | 7,222,929 |
| 6,739,701 | 7,073,881 | 7,155,823 | 7,219,427 | 7,008,503 |
| 6,783,216 | 6,883,890 | 6,857,726 | 7,347,952 | 6,641,256 |
| 6,808,253 | 6,827,428 | 6,802,587 | 6,997,534 | 6,959,982 |
| 6,959,981 | 6,886,917 | 6,969,473 | 6,827,425 | 7,007,859 |
| 6,802,594 | 6,792,754 | 6,860,107 | 6,786,043 | 6,863,378 |
| 7,052,114 | 7,001,007 | 7,551,201 | 10/729,157 | 6,948,794 |
| 6,805,435 | 6,733,116 | 7,391,435 | 7,008,046 | 6,880,918 |
| 7,066,574 | 6,983,595 | 6,923,527 | 7,275,800 | 7,163,276 |
| 7,156,495 | 6,976,751 | 6,994,430 | 7,014,296 | 7,059,704 |
| 7,160,743 | 7,175,775 | 7,287,839 | 7,097,283 | 7,140,722 |
| 7,664,647 | 7,610,203 | 7,080,893 | 7,093,920 | 7,270,492 |
| 7,128,093 | 7,052,113 | 7,055,934 | 7,367,729 | 7,278,796 |
| 7,419,250 | 7,083,263 | 7,145,592 | 7,025,436 | 7,455,390 |
| 7,258,421 | 7,396,108 | 7,332,051 | 7,226,147 | 7,448,725 |
| 7,195,339 | 7,524,032 | 7,618,122 | 7,284,838 | 7,293,856 |
| 7,350,901 | 7,604,325 | 7,325,901 | 7,588,327 | 7,467,854 |
| 7,431,425 | 7,708,380 | 7,669,964 | 7,465,011 | 7,517,055 |
| 7,465,024 | 7,347,536 | 7,380,580 | 7,441,873 | 7,506,969 |
| 7,571,972 | 7,635,177 | 7,661,795 | 7,370,942 | 7,322,679 |
| 7,607,826 | 11/779,847 | 7,585,066 | 11/847,240 | 7,527,209 |
| 7,517,164 | 7,562,967 | 7,740,337 | 7,669,979 | 7,067,067 |
| 6,776,476 | 6,880,914 | 7,086,709 | 6,783,217 | 7,147,791 |
| 6,929,352 | 7,144,095 | 6,820,974 | 6,918,647 | 6,984,016 |
| 7,192,125 | 6,824,251 | 6,834,939 | 6,840,600 | 6,786,573 |
| 7,144,519 | 6,799,835 | 6,959,975 | 6,959,974 | 7,021,740 |
| 6,935,718 | 6,938,983 | 6,938,991 | 7,226,145 | 7,140,719 |
| 6,988,788 | 7,022,250 | 6,929,350 | 7,011,393 | 7,004,566 |
| 7,175,097 | 6,948,799 | 7,143,944 | 7,310,157 | 7,029,100 |
| 6,957,811 | 7,073,724 | 7,055,933 | 7,077,490 | 7,055,940 |
| 7,484,840 | 7,234,645 | 7,032,999 | 7,066,576 | 7,229,150 |
| 7,086,728 | 7,246,879 | 7,284,825 | 7,140,718 | 7,284,817 |
| 7,144,098 | 7,044,577 | 7,284,824 | 7,284,827 | 7,189,334 |
| 7,055,935 | 7,152,860 | 7,588,323 | 7,591,547 | 7,334,868 |
| 7,213,989 | 7,341,336 | 7,364,377 | 7,300,141 | 7,114,868 |
| 7,168,796 | 7,159,967 | 7,328,966 | 7,152,805 | 7,431,429 |
| 7,609,405 | 7,133,799 | 7,380,912 | 7,441,875 | 7,152,956 |
| 7,128,399 | 7,147,305 | 7,287,702 | 7,325,904 | 7,246,884 |
| 7,152,960 | 7,380,929 | 7,441,867 | 7,470,003 | 7,465,022 |
| 7,467,859 | 7,401,895 | 7,270,399 | 6,857,728 | 6,857,729 |
| 6,857,730 | 6,989,292 | 7,126,216 | 6,977,189 | 6,982,189 |
| 7,173,332 | 7,026,176 | 6,979,599 | 6,812,062 | 6,886,751 |
| 7,511,744 | 7,471,313 | 7,001,793 | 6,866,369 | 6,946,743 |
| 7,322,675 | 6,886,918 | 7,059,720 | 7,306,305 | 7,350,887 |
| 7,334,855 | 7,360,850 | 7,347,517 | 6,951,390 | 6,981,765 |
| 6,789,881 | 6,802,592 | 7,029,097 | 6,799,836 | 7,048,352 |
| 7,182,267 | 7,025,279 | 6,857,571 | 6,817,539 | 6,830,198 |
| 6,992,791 | 7,038,809 | 6,980,323 | 7,148,992 | 7,139,091 |
| 6,947,173 | 7,101,034 | 6,969,144 | 6,942,319 | 6,827,427 |
| 6,984,021 | 6,984,022 | 6,869,167 | 6,918,542 | 7,007,852 |
| 6,899,420 | 6,918,665 | 6,997,625 | 6,988,840 | 6,984,080 |
| 6,845,978 | 6,848,687 | 6,840,512 | 6,863,365 | 7,204,582 |
| 6,921,150 | 7,128,396 | 6,913,347 | 7,008,819 | 6,935,736 |
| 6,991,317 | 7,284,836 | 7,055,947 | 7,093,928 | 7,100,834 |
| 7,270,396 | 7,187,086 | 7,290,856 | 7,032,825 | 7,086,721 |
| 7,159,968 | 7,010,456 | 7,147,307 | 7,111,925 | 7,334,867 |
| 7,229,154 | 7,458,676 | 7,370,938 | 7,328,994 | 7,341,672 |
| 7,549,724 | 7,467,848 | 7,278,711 | 7,290,720 | 7,314,266 |
| 7,431,065 | 7,357,488 | 7,513,604 | 7,537,323 | 7,287,706 |
| 7,533,967 | 7,556,351 | 7,470,995 | 11/785,108 | 7,373,083 |
| 7,362,971 | 7,597,421 | 7,350,906 | 11/764,778 | 7,556,356 |
| 7,581,815 | 7,753,485 | 7,506,965 | 7,549,730 | 7,506,966 |

-continued

| | | | | |
|---|---|---|---|---|
| 11/866,307 | 11/866,340 | 7,540,591 | 11/869,722 | 11/869,694 |
| 7,464,881 | | | | |

BACKGROUND OF THE INVENTION

Many different types of printing have been invented, a large number of which are presently in use. The known forms of print have a variety of methods for marking the print media with a relevant marking media. Commonly used forms of printing include offset printing, laser printing and copying devices, dot matrix type impact printers, thermal paper printers, film recorders, thermal wax printers, dye sublimation printers and ink jet printers both of the drop on demand and continuous flow type. Each type of printer has its own advantages and problems when considering cost, speed, quality, reliability, simplicity of construction and operation etc.

In recent years, the field of ink jet printing, wherein each individual pixel of ink is derived from one or more ink nozzles has become increasingly popular primarily due to its inexpensive and versatile nature.

Many different techniques on ink jet printing have been invented. For a survey of the field, reference is made to an article by J Moore, "Non-Impact Printing: Introduction and Historical Perspective", Output Hard Copy Devices, Editors R Dubeck and S Sherr, pages 207-220 (1988).

Ink Jet printers themselves come in many different types. The utilization of a continuous stream of ink in ink jet printing appears to date back to at least 1929 wherein U.S. Pat. No. 1,941,001 by Hansell discloses a simple form of continuous stream electro-static ink jet printing.

U.S. Pat. No. 3,596,275 by Sweet also discloses a process of a continuous ink jet printing including the step wherein the ink jet stream is modulated by a high frequency electro-static field so as to cause drop separation. This technique is still utilized by several manufacturers including Elmjet and Scitex (see also U.S. Pat. No. 3,373,437 by Sweet et al)

Piezoelectric ink jet printers are also one form of commonly utilized ink jet printing device. Piezoelectric systems are disclosed by Kyser et. al. in U.S. Pat. No. 3,946,398 (1970) which utilizes a diaphragm mode of operation, by Zolten in U.S. Pat. No. 3,683,212 (1970) which discloses a squeeze mode of operation of a piezoelectric crystal, Stemme in U.S. Pat. No. 3,747,120 (1972) discloses a bend mode of piezoelectric operation, Howkins in U.S. Pat. No. 4,459,601 discloses a piezoelectric push mode actuation of the ink jet stream and Fischbeck in U.S. Pat. No. 4,584,590 which discloses a shear mode type of piezoelectric transducer element.

Recently, thermal inkjet printing has become an extremely popular form of ink jet printing. The ink jet printing techniques include those disclosed by Endo et al in GB 2007162 (1979) and Vaught et al in U.S. Pat. No. 4,490,728. Both the aforementioned references disclosed ink jet printing techniques that rely upon the activation of an electrothermal actuator which results in the creation of a bubble in a constricted space, such as a nozzle, which thereby causes the ejection of ink from an aperture connected to the confined space onto a relevant print media. Printing devices utilizing the electro-thermal actuator are manufactured by manufacturers such as Canon and Hewlett Packard.

As can be seen from the foregoing, many different types of printing technologies are available. Ideally, a printing technology should have a number of desirable attributes. These include inexpensive construction and operation, high speed operation, safe and continuous long term operation etc. Each technology may have its own advantages and disadvantages in the areas of cost, speed, quality, reliability, power usage, simplicity of construction operation, durability and consumables.

Supplying ink from an ink reservoir to many thousand densely packed nozzles is a particular challenge in high-resolution pagewidth printing. In order to achieve a high nozzle density, ink inlets which feed ink into each nozzle chamber, necessarily have a relatively small bore. Typically, these ink supply inlets have a diameter of about 5 to 40 microns. As such, these ink inlets may become blocked with particulates and consequently have a deleterious effect on nozzle operation. Although some nozzle failures may be compensated by other mechanisms (e.g. redundant rows of nozzles, as described in U.S. Pat. No. 7,252,353, the contents of which is incorporated herein by reference), it would be desirable to obviate any compensatory mechanisms by ensuring that each nozzle does not fail due to ink supply blockages.

SUMMARY OF THE INVENTION

In a first aspect the present invention provides a printhead comprising a plurality of inkjet nozzle assemblies, each nozzle assembly comprising:

a nozzle chamber formed on a substrate, said nozzle chamber comprising a roof spaced apart from said substrate and sidewalls extending between said roof and said substrate, said nozzle chamber having an ink ejection opening defined in said roof, a first ink inlet defined in one of said sidewalls, and a second ink inlet defined in a floor of the nozzle chamber, each ink inlet being in fluid communication with a common ink reservoir; and an actuator for ejection of ink through said ink ejection opening.

Optionally, an areal density of said nozzle assemblies is at least 10,000 nozzles per square cm of printhead surface.

Optionally, each ink inlet has a width of less than about 40 microns.

Optionally, each roof defines part of a nozzle plate spanning across the plurality of nozzle assemblies.

Optionally, said nozzle chambers are arranged in rows, each row of nozzle chambers having an associated ink conduit extending longitudinally adjacent said row, said ink conduit being defined between said nozzle plate and said substrate.

Optionally, said first ink receives ink from said ink conduit.

Optionally, an ink supply channel is defined in said printhead for supplying ink to a plurality of nozzle chambers, and each ink inlet of one nozzle chamber is in fluid communication with said ink supply channel.

Optionally, said nozzle assemblies are arranged in rows, and said ink supply channel extends longitudinally along said printhead for supplying ink to all nozzle chambers contained in at least one of said rows.

In a further aspect the printhead has a first row for printing ink of a first color and a second row for printing ink of a second color, said first row of nozzle assemblies receiving ink from a first ink supply channel, and said second row of nozzle assemblies receiving ink from a second ink supply channel.

Optionally, said ink supply channel is configured for receiving ink from a backside of said printhead, said backside being an opposite side to an ink ejection side having said nozzle assemblies.

Optionally, said actuator is contained in said nozzle chamber.

Optionally, said actuator is a bubble-forming heater element.

In another aspect the present invention provides an inkjet nozzle assembly comprising:

a nozzle chamber formed on a substrate, said nozzle chamber comprising a roof spaced apart from said substrate and sidewalls extending between said roof and said substrate, said nozzle chamber having an ink ejection opening defined in said roof, a first ink inlet defined in one of said sidewalls, and a second ink inlet defined in a floor of the nozzle chamber, each ink inlet being in fluid communication with a common ink reservoir; and an actuator for ejection of ink through said ink ejection opening.

In another aspect the present invention provides a printhead integrated circuit comprising a substrate;

a plurality of inkjet nozzle assemblies formed on said substrate, each nozzle assembly comprising:

a nozzle chamber formed on a substrate, said nozzle chamber comprising a roof spaced apart from said substrate and sidewalls extending between said roof and said substrate, said nozzle chamber having an ink ejection opening defined in said roof, a first ink inlet defined in one of said sidewalls, and a second ink inlet defined in a floor of the nozzle chamber, each ink inlet being in fluid communication with a common ink reservoir; and an actuator for ejection of ink through said ink ejection opening; and drive circuitry electrically connected to each of said actuators.

In another aspect the present invention provides an inkjet printer comprising:

at least one ink reservoir; and a printhead in fluid communication with said at least one ink reservoir, said printhead comprising a plurality of inkjet nozzle assemblies, each nozzle assembly comprising:

a nozzle chamber formed on a substrate, said nozzle chamber comprising a roof spaced apart from said substrate and sidewalls extending between said roof and said substrate, said nozzle chamber having an ink ejection opening defined in said roof, a first ink inlet defined in one of said sidewalls, and a second ink inlet defined in a floor of the nozzle chamber, each ink inlet being in fluid communication with a common ink reservoir; and an actuator for ejection of ink through said ink ejection opening.

In a further aspect the printer comprising:

a first ink reservoir;

a second ink reservoir;

a plurality of first inkjet nozzle assemblies, each of said first inkjet nozzle assemblies comprising a first nozzle chamber having a plurality of inlets in fluid communication with said first ink reservoir; and a plurality of second inkjet nozzle assemblies, each of said second inkjet nozzle assemblies comprising a first nozzle chamber having a plurality of inlets in fluid communication with said second ink reservoir.

BRIEF DESCRIPTION OF THE DRAWINGS

Optional embodiments of the present invention will now be described by way of example only with reference to the accompanying drawings, in which.

DESCRIPTION OF OPTIONAL EMBODIMENTS

The present invention may be used with any type of printhead. The present Applicant has previously described a plethora of inkjet printheads. It is not necessary to describe all such printheads here for an understanding of the present invention. However, the present invention will now be described in connection with a thermal bubble-forming inkjet printhead. For the avoidance of doubt, all references herein to "ink" should be construed to mean any ejectable printing fluid and includes, for example, traditional inks, invisible inks, fixatives and other printable fluids.

Inkjet Nozzle Chambers Having Single Ink Inlets

Hitherto, we have described a thermal bubble-forming inkjet printhead, in which ink is supplied to a nozzle chamber from an ink conduit via a sidewall of the nozzle chamber. Such a printhead was described, for example, in our earlier US Publication No. 2007/0081044, the contents of which is herein incorporated by reference.

Figure 1:
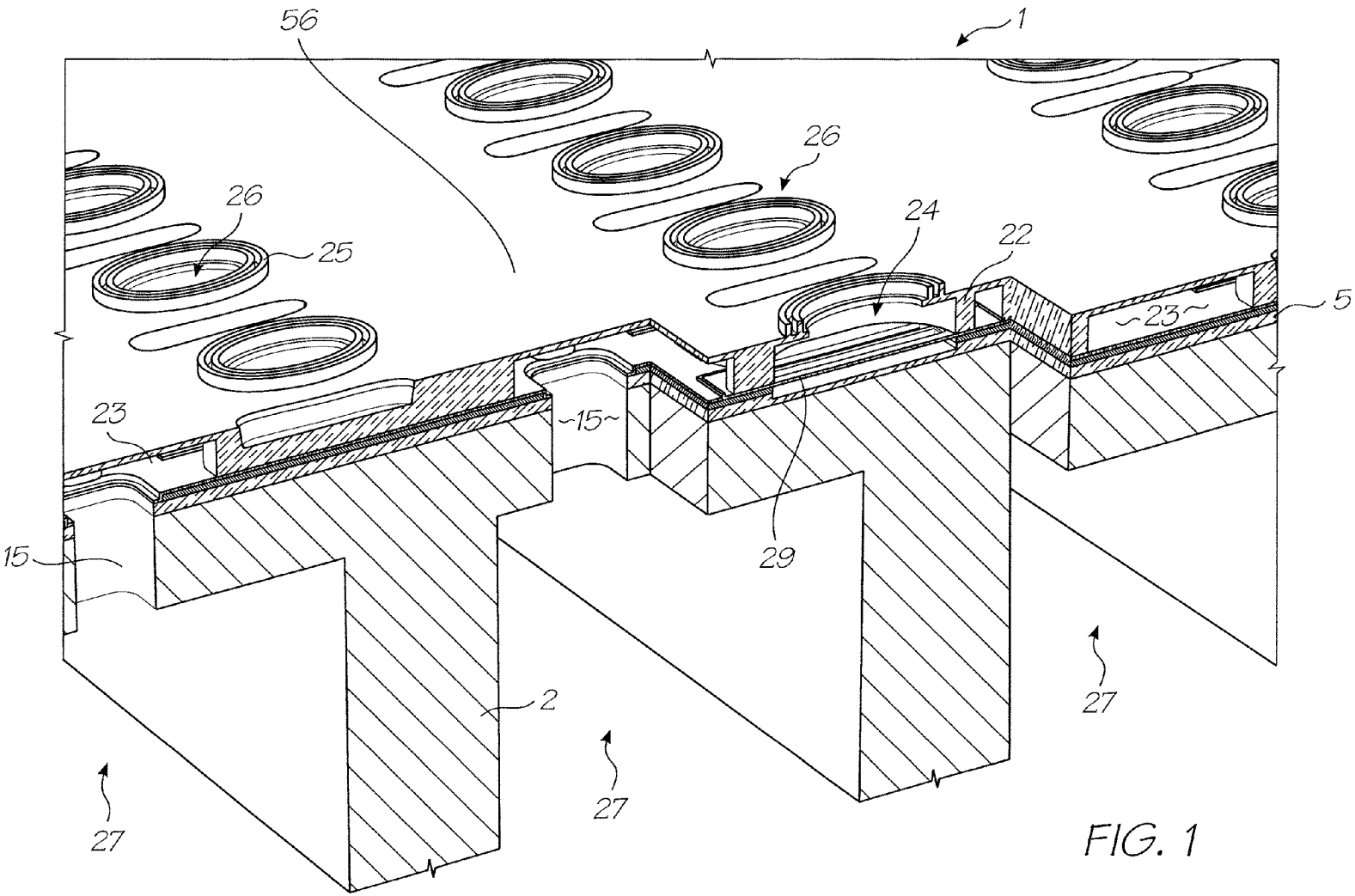
FIG. 1 is a partial perspective view of an array of nozzle assemblies with nozzle chambers having a sidewall ink inlet.
Figure 2:
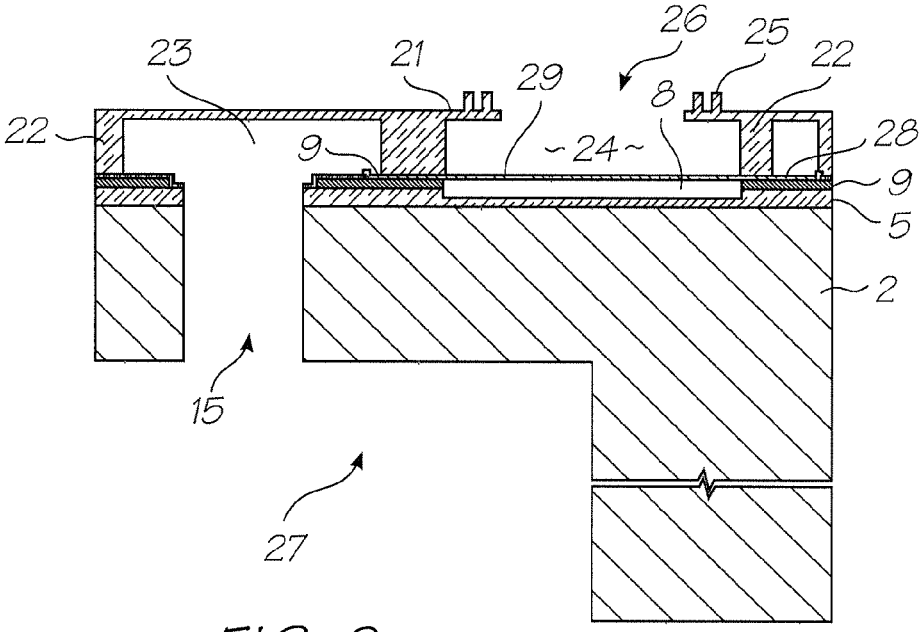
FIG. 2 is a side view of a nozzle assembly unit cell shown in FIG. 1.
Figure 3:
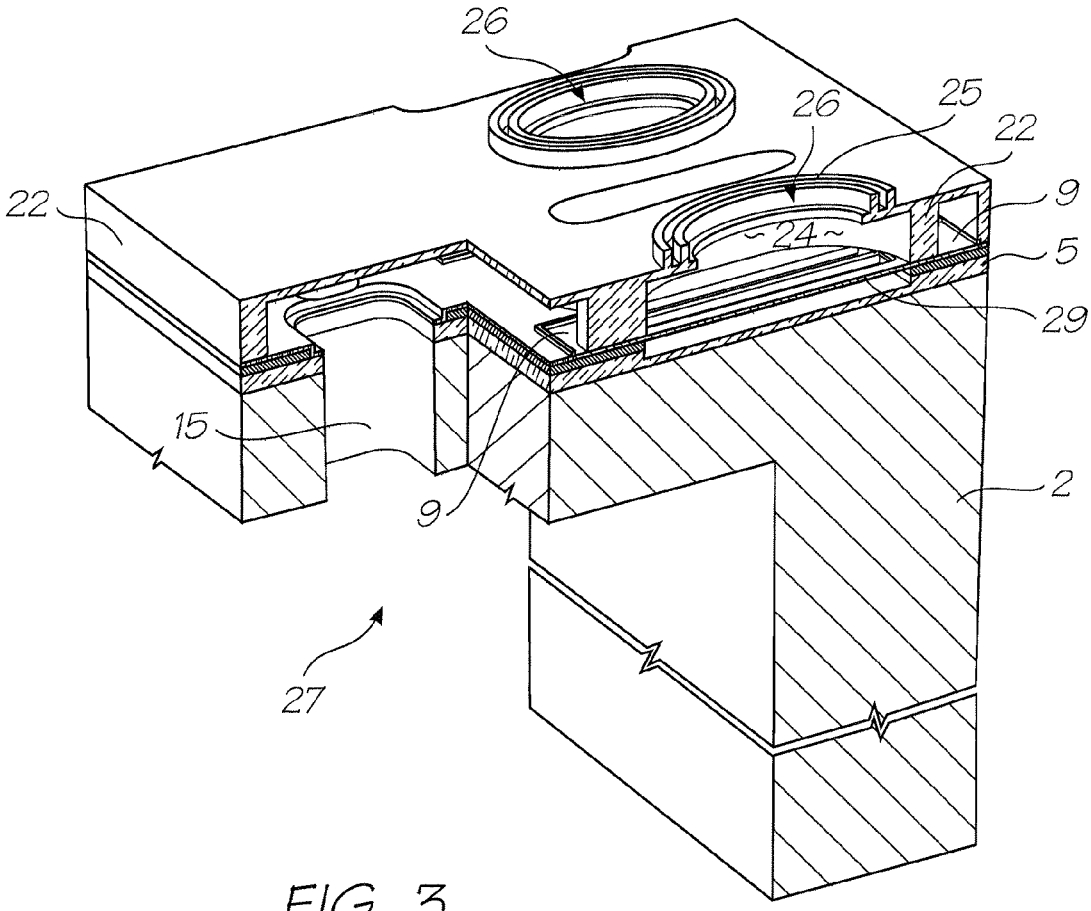
FIG. 3 is a perspective of the nozzle assembly shown in FIG. 2.

Referring to FIG. 1, there is shown a part of a first prior-disclosed printhead 1 comprising a plurality of nozzle assemblies. FIGS. 2 and 3 show one of these nozzle assemblies in side-section and cutaway perspective views.

Each nozzle assembly comprises a nozzle chamber 24 formed by MEMS fabrication techniques on a silicon wafer substrate 2. The nozzle chamber 24 is defined by a roof 21 and sidewalls 22 which extend from the roof 21 to the silicon substrate 2. As shown in FIG. 1, each roof is defined by part of a nozzle plate 56, which spans across an ejection face of the printhead 1. The nozzle plate 56 and sidewalls 22 are formed of the same material, which is deposited by PECVD over a sacrificial scaffold of photoresist during MEMS fabrication. Typically, the nozzle plate 56 and sidewalls 22 are formed of a ceramic material, such as silicon dioxide or silicon nitride. These hard materials have excellent properties for printhead robustness, and their inherently hydrophilic nature is advantageous for supplying ink to the nozzle chambers 24 by capillary action.

Returning to the details of the nozzle chamber 24, it will be seen that a nozzle opening 26 is defined in a roof of each nozzle chamber 24. Each nozzle opening 26 is generally elliptical and has an associated nozzle rim 25. The nozzle rim 25 assists with drop directionality during printing as well as reducing, at least to some extent, ink flooding from the nozzle opening 26. The actuator for ejecting ink from the nozzle chamber 24 is a heater element 29 positioned beneath the nozzle opening 26 and suspended across a pit 8. Current is supplied to the heater element 29 via electrodes 9 connected to drive circuitry in underlying CMOS layers 5 of the substrate 2. When a current is passed through the heater element 29, it rapidly superheats surrounding ink to form a gas bubble, which forces ink through the nozzle opening. By suspending the heater element 29, it is completely immersed in ink when the nozzle chamber 24 is primed. This improves printhead efficiency, because less heat dissipates into the underlying substrate 2 and more input energy is used to generate a bubble.

As seen most clearly in FIG. 1, the nozzles are arranged in rows and an ink supply channel 27, which extends longitudinally along the printhead, supplies ink to each nozzle in the row. Each row of nozzles has an associated ink conduit 23 extending longitudinally along the row. The ink conduit is defined between the nozzle plate 56 and the substrate 2. The ink conduit 23 receives ink from the ink supply channel 27 via ink inlet passages 15 interconnecting the ink conduit and the ink supply channel. The ink conduit 23 delivers inks to individual nozzle chambers 24 via a sidewall inlet defined in a sidewall 22 of each nozzle chamber 24. An advantage of supplying from via a sidewall 22 of the ink chamber 24 is that filter structures can be readily constructed at the chamber inlet. Sidewall ink delivery also has some benefits in dampening ink surges. Ink surges can be a cause of flooding in pagewidth printheads, where a relatively large mass of ink moving ink has a relatively high inertia.

Hitherto, we have also described a thermal bubble-forming inkjet printhead 100, in which ink is supplied to a nozzle chamber from an ink inlet defined in a floor of the nozzle chamber. Such a printhead was described, for example, in U.S. Pat. No. 6,755,509 and US Publication No. 2005/0168543, the contents of which are herein incorporated by reference.

Figure 4:
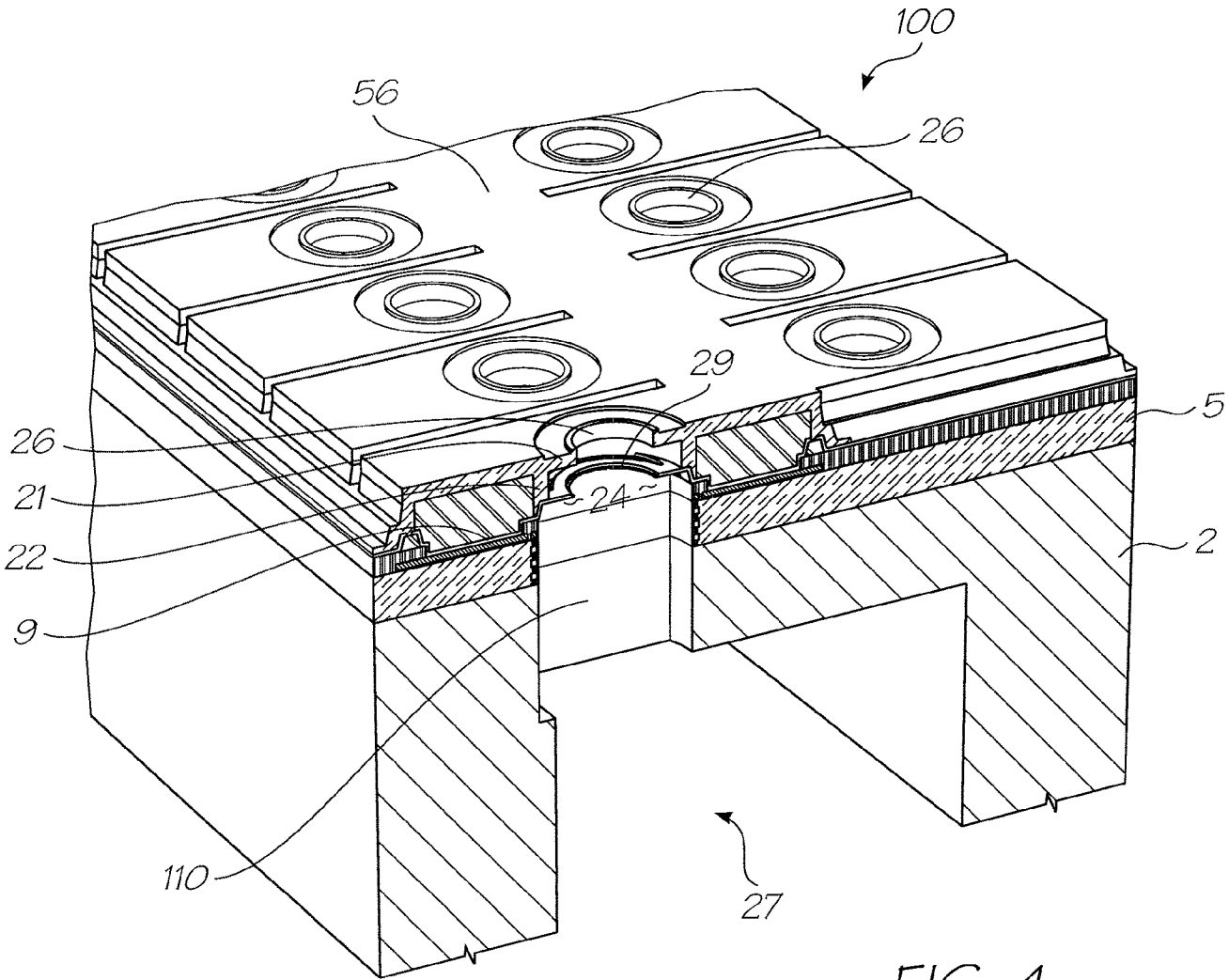
FIG. 4 is a perspective view of a nozzle assembly with a nozzle chamber having a floor ink inlet.

Referring to FIG. 4, there is shown a part of a second prior-disclosed printhead 100 comprising a plurality of nozzle assemblies. For clarity of understanding, features common to the printhead 1 and the printhead 100 are labeled with the same reference numerals.

Each nozzle assembly of the printhead 100 comprises a nozzle chamber 24 formed by MEMS fabrication techniques on a silicon wafer substrate 2. The nozzle chamber 24 is defined by a roof 21 and sidewalls 22 which extend from the roof 21 to the silicon substrate 2. As shown in FIG. 4, each roof is defined by part of a nozzle plate 56, which spans across an ejection face of the printhead 100. The nozzle plate 56 and sidewalls 22 are formed of the same material, which is deposited by PECVD over a sacrificial scaffold of photoresist during MEMS fabrication. Typically, the nozzle plate 56 and sidewalls 22 are formed of a ceramic material, such as silicon dioxide or silicon nitride.

A nozzle opening 26 is defined in the roof 21 of each nozzle chamber 24. The actuator for ejecting ink from the nozzle chamber 24 is a heater element 29 positioned beneath the nozzle opening 26 and suspended across a pit 8. Current is supplied to the heater element 29 via electrodes 9 connected to drive circuitry in underlying CMOS layers 5 of the substrate 2. When a current is passed through the heater element 29, it rapidly superheats surrounding ink to form a gas bubble, which forces ink through the nozzle opening 26.

Hence, the printhead 100 has nozzles functioning in an identical manner to the nozzles in printhead 1. Furthermore, ink is supplied to each nozzle chamber 24 from an ink supply channel 27, which extends longitudinally along the printhead and parallel with nozzle rows. However, unlike the printhead 1 described above, ink is delivered to each nozzle chamber 24 via an ink inlet passage 110 interconnecting the ink supply channel 27 and the nozzle chamber. Hence, ink is received by the nozzle chamber 24 via the floor of the chamber rather than via the sidewall 22 of the chamber. It will be appreciated that, with the arrangement shown in FIG. 4, there is no ink conduit 23 extending longitudinally along the printhead between the nozzle plate 56 and the substrate.

Inkjet Nozzle Chambers Having a Plurality of Ink Inlets

A printhead 200 is now described, wherein each nozzle chamber has a plurality of ink inlets. For clarity of understanding, features common to the printhead 1, the printhead 100 and the printhead 200 are labeled with the same reference numerals.

Figure 5:
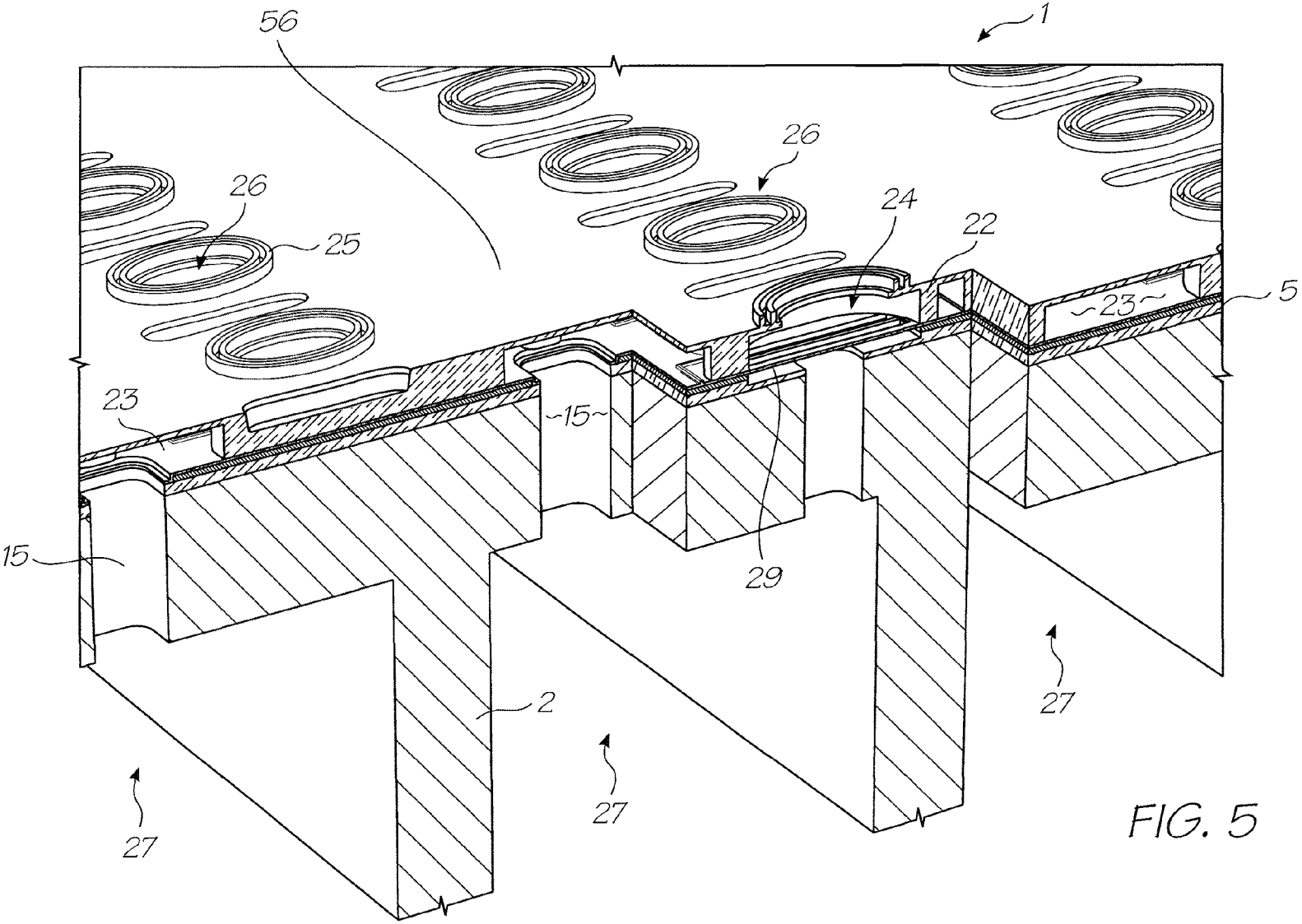
FIG. 5 is a partial perspective view of an array of nozzle assemblies with dual ink inlets.
Figure 6:
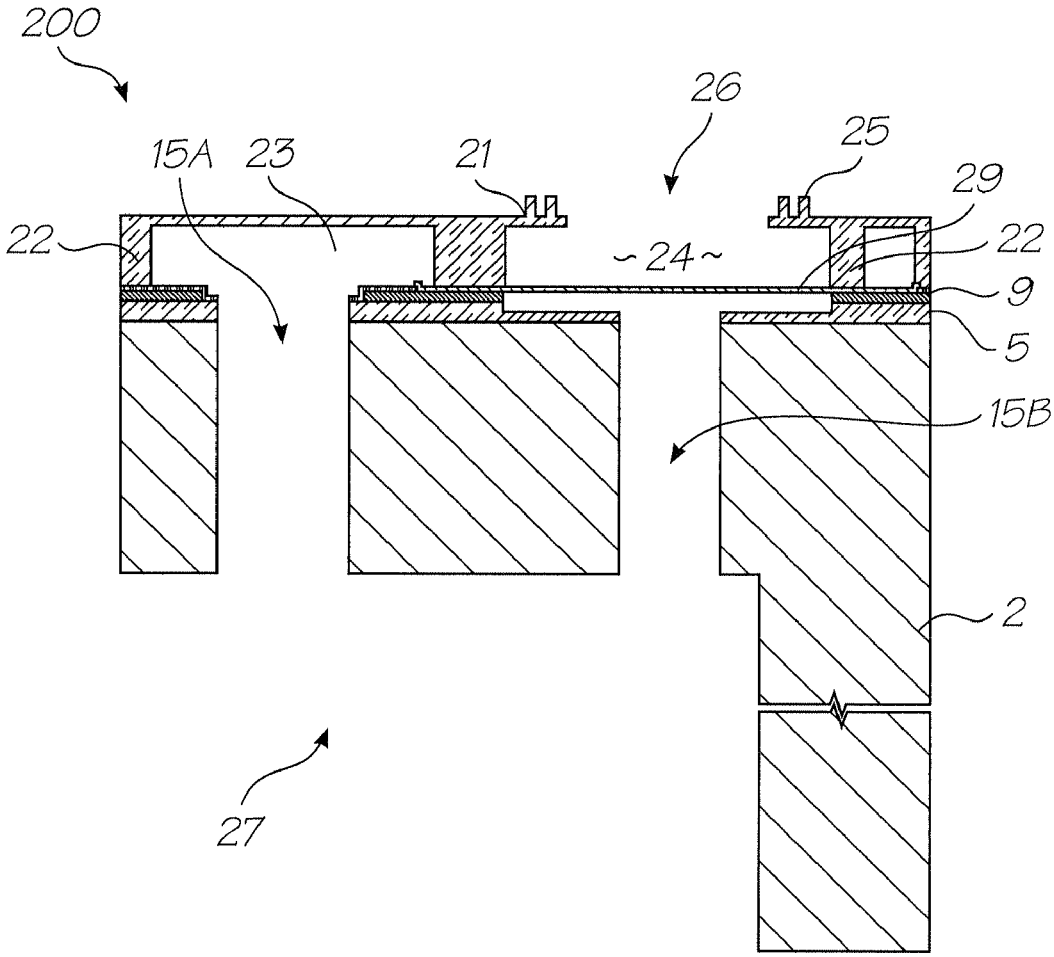
FIG. 6 is a side view of a nozzle assembly unit cell shown in FIG. 5.
Figure 7:
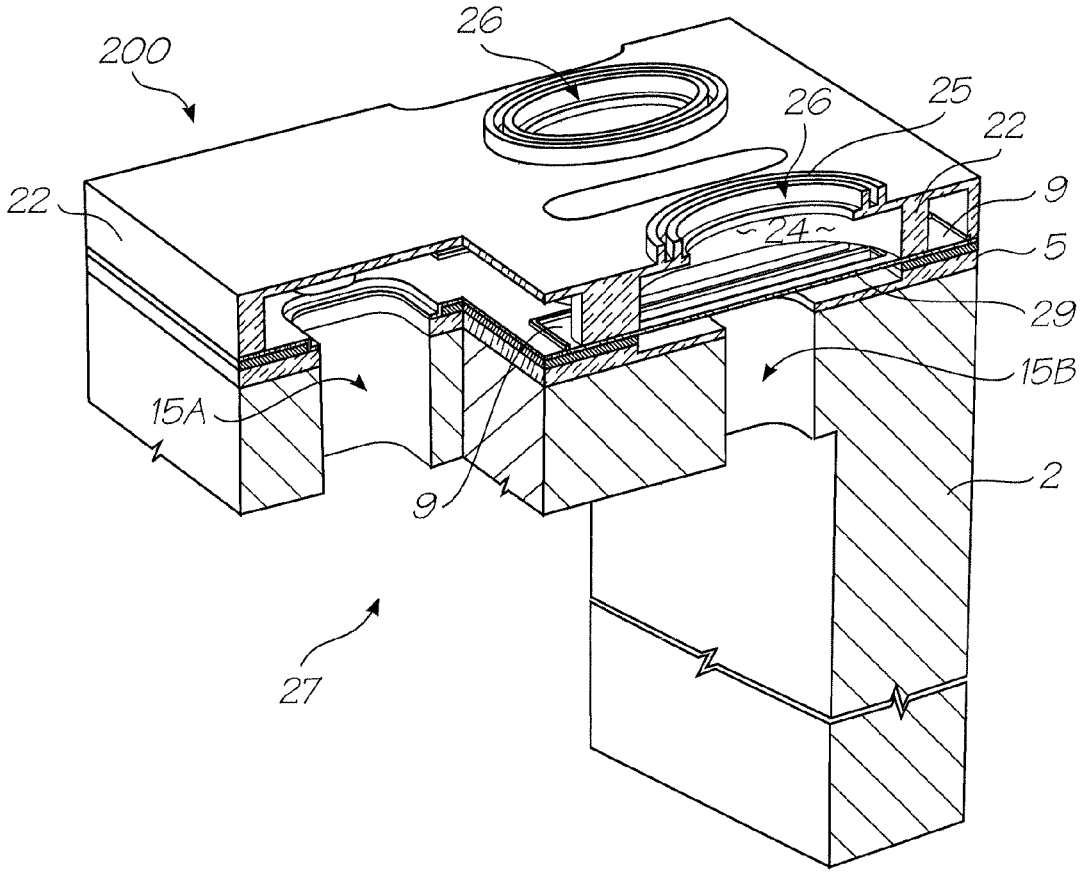
FIG. 7 is a perspective of the nozzle assembly shown in FIG. 6.

Referring to FIGS. 5 to 7, the printhead 200 is of similar construction to the printhead 1. Hence, each row of nozzles has an associated ink conduit 23 extending longitudinally along the row. The ink conduit 23 is defined between the nozzle plate 56 and the substrate 2. Furthermore, the ink conduit 23 receives ink from the ink supply channel 27 via ink inlet passages 15A, and delivers inks to individual nozzle chambers 24 via a first ink inlet defined in a sidewall of each nozzle chamber. However, in addition to this ink inlet passage 15A, a further ink inlet passage 15B is provided, which interconnects the ink supply channel 27 and the floor of the ink chamber 24 have a second ink inlet defined therein. Thus, the nozzle chamber 24 receives ink via first and second ink inlets from two separate inlet passages 15A and 15B, which are both connected to a common ink supply channel 27.

An advantage of this arrangement is that it introduces redundancy into the ink supply for each nozzle. If one of the ink supply passages 15A or 15B becomes blocked for any reason, then the nozzle chamber 24 can still receive ink from the other ink supply passage, and nozzle malfunctioning can be avoided. This redundancy is particularly beneficial in printheads having a high nozzle density, where the maximum dimension of each ink inlet passage 15 is necessarily small (typically less than 40 microns, less than 30 microns or less than 20 microns) and more susceptible to blockage. The common ink supply channel 27 is significantly wider than each of the inlet passages 15A and 15B and is, therefore, much less susceptible to blockage.

The fabrication of the printhead 200 will be readily apparent from the detailed fabrication processes described in US Publication No. 2007/0081044 and U.S. Pat. No. 6,755,509. Suitable modification of these processes to provide a printhead in accordance with the present invention will be well within the ambit of the person skilled in the art.

Whilst the present invention has been exemplified for one of the Applicant's MEMS inkjet printheads, it will be readily appreciated that any type of inkjet printhead having a plurality of nozzle chamber inlets would realize the same advantages discussed above, and particularly inkjet printheads having high nozzle densities. A printhead having a high nozzle density is typically considered to be one where an areal density of the nozzles relative to the substrate surface exceeds 10,000 nozzles per square cm of substrate surface.

Figure 8:
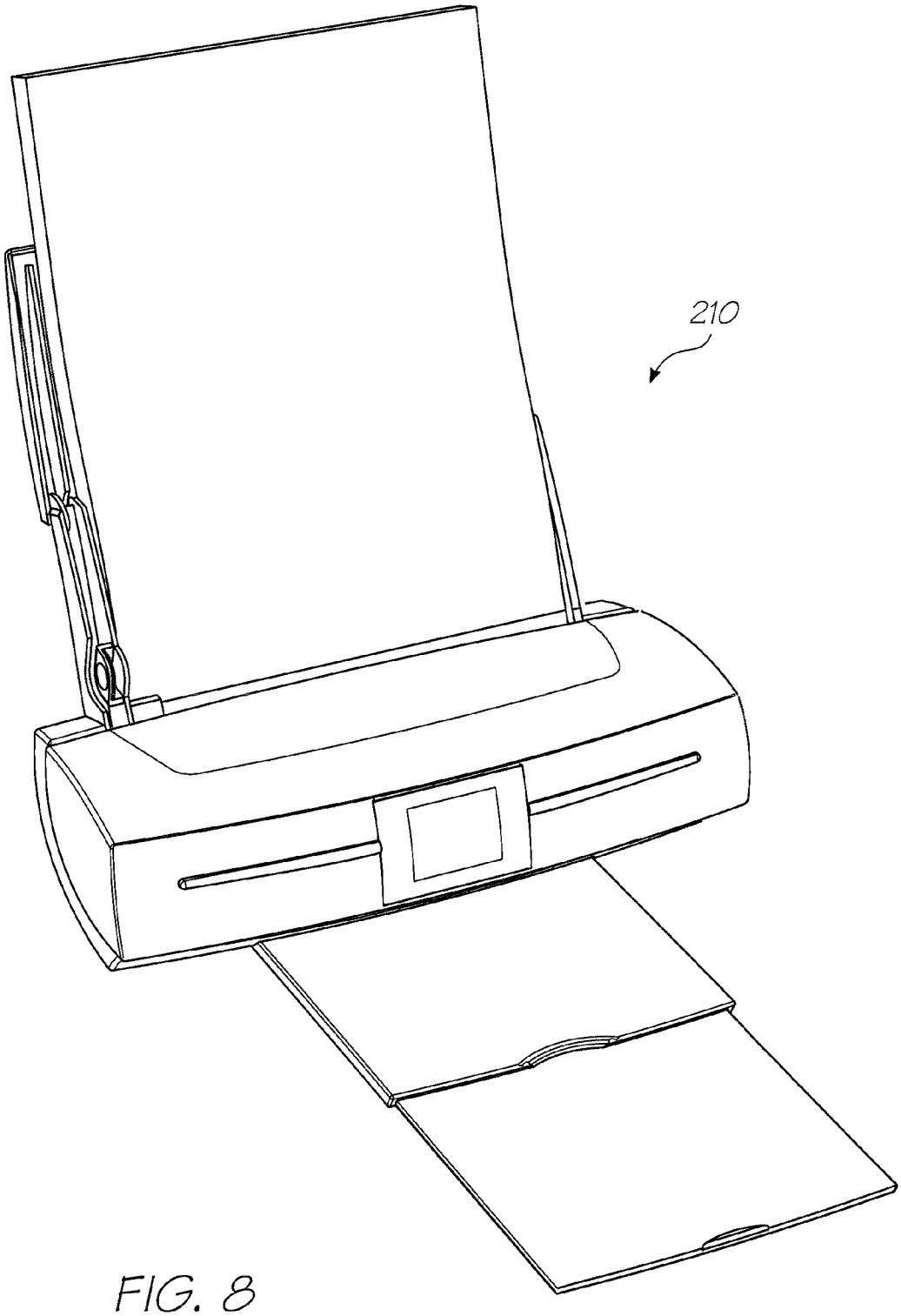
FIG. 8 is a perspective view of an inkjet printer.
Figure 9:
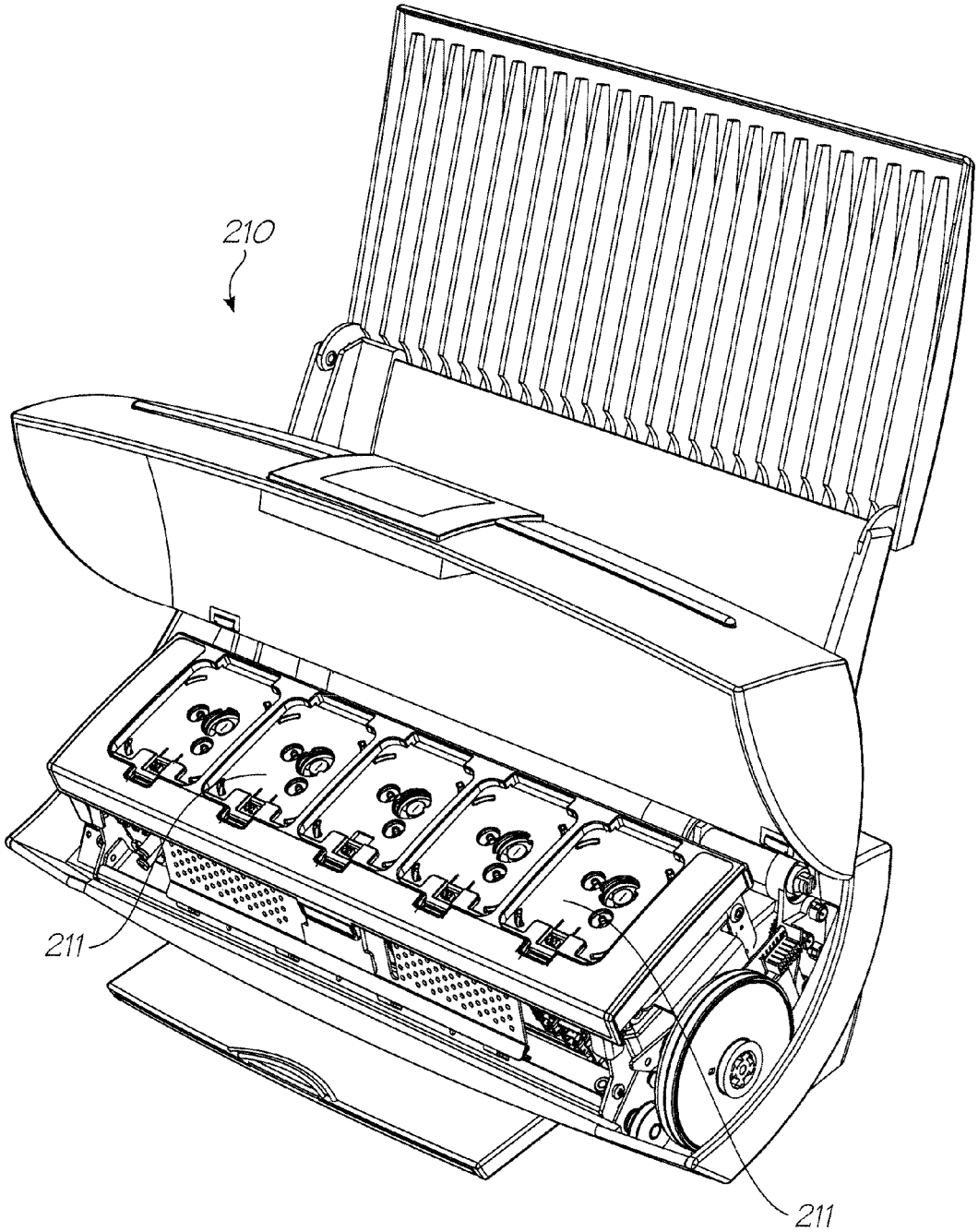
FIG. 9 is a perspective view of the inkjet printer shown in FIG. 7 with ink cartridges exposed.

Self-evidently, printheads described herein may be used in inkjet printers. FIGS. 8 and 9 show a typical pagewidth inkjet printer 210, as described in Applicant's US Publication No. 2005/0168543. The printer 210 includes a plurality of ink reservoirs in the form of ink cartridges 211, which are in fluid communication with a printhead (not shown in FIGS. 8 and 9). Each ink cartridge 211 supplies ink to a different color channel in the printhead. A color channel typically contains one or more rows of nozzles.

It will be appreciated by ordinary workers in this field that numerous variations and/or modifications may be made to the present invention as shown in the specific embodiments without departing from the spirit or scope of the invention as broadly described. The present embodiments are, therefore, to be considered in all respects to be illustrative and not restrictive.

The invention claimed is:

1. A printhead comprising a plurality of inkjet nozzle assemblies, each nozzle assembly comprising:

a nozzle chamber formed on a substrate, said nozzle chamber comprising a roof spaced apart from said substrate and sidewalls extending between said roof and said substrate, said nozzle chamber having an ink ejection opening defined in said roof, a first ink inlet defined in one of said sidewalls, and a second ink inlet defined in a floor of the nozzle chamber, each ink inlet being in fluid communication with a common ink reservoir; and an actuator for ejection of ink through said ink ejection opening, wherein said nozzle chambers are arranged in rows, each row of nozzle chambers having an associated ink conduit extending longitudinally adjacent said row, said ink conduit being defined between said nozzle plate and said substrate.

2. The printhead of claim 1, wherein an areal density of said nozzle assemblies is at least 10,000 nozzles per square cm of printhead surface.

3. The printhead of claim 1, wherein each ink inlet has a width of less than about 40 microns.

4. The printhead of claim 1, wherein each roof defines part of a nozzle plate spanning across the plurality of nozzle assemblies.

5. The printhead of claim 1, wherein said first ink inlet receives ink from said ink conduit.

6. The printhead of claim 1, wherein an ink supply channel is defined in said printhead for supplying ink to a plurality of nozzle chambers, and each ink inlet of one nozzle chamber is in fluid communication with said ink supply channel.

7. The printhead of claim 6, wherein said nozzle assemblies are arranged in rows, and said ink supply channel extends longitudinally along said printhead for supplying ink to all nozzle chambers contained in at least one of said rows.

8. The printhead of claim 7 having a first row for printing ink of a first color and a second row for printing ink of a second color, said first row of nozzle assemblies receiving ink from a first ink supply channel, and said second row of nozzle assemblies receiving ink from a second ink supply channel.

9. The printhead of claim 6, wherein said ink supply channel is configured for receiving ink from a backside of said printhead, said backside being an opposite side to an ink ejection side having said nozzle assemblies.

10. The printhead of claim 1, wherein said actuator is contained in said nozzle chamber.

11. The printhead of claim 1, wherein said actuator is a bubble-forming heater element.

12. An inkjet nozzle assembly comprising:

a nozzle chamber formed on a substrate, said nozzle chamber comprising a roof spaced apart from said substrate and sidewalls extending between said roof and said substrate, said nozzle chamber having an ink ejection opening defined in said roof, a first ink inlet defined in one of said sidewalls, and a second ink inlet defined in a floor of the nozzle chamber, each ink inlet being in fluid communication with a common ink reservoir; and an actuator for ejection of ink through said ink ejection opening, wherein said nozzle chambers are arranged in rows, each row of nozzle chambers having an associated ink conduit extending longitudinally adjacent said row, said ink conduit being defined between said nozzle plate and said substrate.

13. A printhead integrated circuit comprising a substrate;

a plurality of inkjet nozzle assemblies formed on said substrate, each nozzle assembly comprising:

a nozzle chamber formed on a substrate, said nozzle chamber comprising a roof spaced apart from said substrate and sidewalls extending between said roof and said substrate, said nozzle chamber having an ink ejection opening defined in said roof, a first ink inlet defined in one of said sidewalls, and a second ink inlet defined in a floor of the nozzle chamber, each ink inlet being in fluid communication with a common ink reservoir; and an actuator for ejection of ink through said ink ejection opening; and drive circuitry electrically connected to each of said actuators, wherein said nozzle chambers are arranged in rows, each row of nozzle chambers having an associated ink conduit extending longitudinally adjacent said row, said ink conduit being defined between said nozzle plate and said substrate.

14. An inkjet printer comprising:

an ink reservoir; and a printhead in fluid communication with said at least one ink reservoir, said printhead comprising a plurality of inkjet nozzle assemblies, each nozzle assembly comprising:

a nozzle chamber formed on a substrate, said nozzle chamber comprising a roof spaced apart from said substrate and sidewalls extending between said roof and said substrate, said nozzle chamber having an ink ejection opening defined in said roof, a first ink inlet defined in one of said sidewalls, and a second ink inlet defined in a floor of the nozzle chamber, each ink inlet being in fluid communication with the ink reservoir; and an actuator for ejection of ink through said ink ejection opening, wherein said nozzle chambers are arranged in rows, each row of nozzle chambers having an associated ink conduit extending longitudinally adjacent said row, said ink conduit being defined between said nozzle plate and said substrate.

15. The printer of claim 14 comprising:

a first ink reservoir;

a second ink reservoir;

a plurality of first inkjet nozzle assemblies, each of said first inkjet nozzle assemblies comprising a first nozzle chamber having a plurality of inlets in fluid communication with said first ink reservoir; and a plurality of second inkjet nozzle assemblies, each of said second inkjet nozzle assemblies comprising a first nozzle chamber having a plurality of inlets in fluid communication with said second ink reservoir.

* * * * *